US008191730B2

(12) United States Patent
Krish, Sr. et al.

(10) Patent No.: US 8,191,730 B2
(45) Date of Patent: Jun. 5, 2012

(54) STAMPED BUCKET FOR VENDING MACHINE AND METHOD OF FORMING SAME

(75) Inventors: Joseph J. Krish, Sr., Loudonville, OH (US); William R. Reis, Grafton, OH (US)

(73) Assignee: The Boehm Pressed Steel Company, Valley City, OH (US)

( * ) Notice: Subject to any disclaimer, the term of this patent is extended or adjusted under 35 U.S.C. 154(b) by 0 days.

(21) Appl. No.: 12/635,414

(22) Filed: Dec. 10, 2009

(65) Prior Publication Data

US 2010/0089942 A1 Apr. 15, 2010

Related U.S. Application Data

(62) Division of application No. 10/430,992, filed on May 7, 2003, now Pat. No. 7,651,006.

(51) Int. Cl.
*A47K 10/24* (2006.01)
*B65H 1/00* (2006.01)

(52) U.S. Cl. ..... 221/48; 221/46; 221/266; 221/267; 221/148; 221/131; 221/152; 221/115; 221/13

(58) Field of Classification Search ..... 221/48, 221/46, 266, 267, 148, 131, 152, 115, 13
See application file for complete search history.

(56) References Cited

U.S. PATENT DOCUMENTS

| | | | | |
|---|---|---|---|---|
| 1,694,599 A | | 12/1928 | Lea | |
| 1,713,333 A | | 5/1929 | Economos | |
| 1,968,500 A | | 7/1934 | Mills | |
| 2,156,196 A | * | 4/1939 | Romanoski | 221/152 |
| 2,895,639 A | | 7/1959 | Little | |
| 3,088,629 A | | 5/1963 | Seymour | |
| 3,231,129 A | | 1/1966 | Coker et al. | |
| 3,392,266 A | | 7/1968 | Stahler | |
| 3,421,657 A | | 1/1969 | Larson | |
| 3,424,345 A | * | 1/1969 | Payne | 221/116 |
| 4,126,217 A | | 11/1978 | Bock | |
| 4,298,138 A | | 11/1981 | Oden | |
| 4,454,961 A | | 6/1984 | Childers et al. | |
| 4,509,658 A | * | 4/1985 | Oden | 221/115 |
| 4,852,767 A | * | 8/1989 | Humphrey | 221/241 |
| 4,940,161 A | | 7/1990 | Hieb | |
| 5,404,797 A | | 4/1995 | Millar | |
| 5,450,980 A | | 9/1995 | Laidlaw | |
| 5,697,519 A | | 12/1997 | Wittern, Jr. et al. | |
| 5,765,719 A | | 6/1998 | Upham et al. | |

(Continued)

FOREIGN PATENT DOCUMENTS

JP 5-128361 A 5/1993

(Continued)

*Primary Examiner* — Gene O. Crawford
*Assistant Examiner* — Rakesh Kumar
(74) *Attorney, Agent, or Firm* — Fay Sharpe LLP

(57) ABSTRACT

A stamped bucket for a vending machine having an elongated body with opposing first and second ends, a first end wall integrally formed on the body along the first end and a second end wall integrally formed on the body along the second end. The first and second end walls extending in generally transverse relation to the body. The first end wall has one or more tab portions extending therefrom that are secured to the body adjacent the first end. The second end wall also has one or more tab portions extending therefrom that are secured to the body adjacent the second end. An axis of rotation extends between the first and second end walls substantially longitudinally along the body.

14 Claims, 31 Drawing Sheets

U.S. PATENT DOCUMENTS

| | | | | |
|---|---|---|---|---|
| 5,799,823 | A * | 9/1998 | Feltrin | 221/298 |
| 5,924,595 | A * | 7/1999 | Crook | 221/93 |
| 6,286,710 | B1 | 9/2001 | Paek | |
| 6,945,427 | B2 * | 9/2005 | Hieb | 221/10 |
| 7,401,710 | B2 * | 7/2008 | Black et al. | 221/131 |
| 7,651,006 | B2 * | 1/2010 | Krish et al. | 221/48 |
| 7,684,893 | B2 * | 3/2010 | Kelly et al. | 700/242 |
| 2004/0030444 | A1 | 2/2004 | Hieb | |
| 2004/0124205 | A1 | 7/2004 | Hieb | |

FOREIGN PATENT DOCUMENTS

| | | | |
|---|---|---|---|
| JP | 8-16899 | | 1/1996 |
| JP | 9-245245 | A | 9/1997 |
| JP | P2000-123243 | A | 4/2000 |
| JP | P2001-236559 | A | 8/2001 |
| JP | 2001-307204 | A | 11/2001 |
| JP | 2002-279504 | | 9/2002 |
| JP | 2004-213154 | A | 7/2004 |

* cited by examiner

STAMPED BUCKET FOR VENDING MACHINE AND METHOD OF FORMING SAME

This application is a divisional of U.S. patent application Ser. No. 10/430,992, filed on May 7, 2003 now U.S. Pat. No. 7,651,006, which is hereby incorporated herein by reference in its entirety.

This invention relates to the art of vending machines and, more particularly, to a bucket for use in a vending machine that is formed or stamped from a sheet of metal.

BACKGROUND OF THE INVENTION

Vending machines, including those adapted to dispense beverage containers, such as cans and plastic bottles, for example, are well known and widely used. Vending machines commonly use a component known as a basket, rotor or bucket to selectively dispense the beverage containers and/or other products from the vending machine. In the interest of clarity and ease of reading, the term bucket will be used throughout this application to refer to such components, though it will be appreciated that the other mentioned terms are also commonly used. The buckets work in conjunction with various other components of the vending machine to ensure that only one beverage container or other product is dispensed per vend operation. As such, these components are known to take various forms and configurations depending upon the structure and features of the other surrounding components. However, it is generally desirable for these components to be of a thin-walled construction so that the overall size thereof can be minimized. This avoids interference with other associated parts and components, and also generally contributes to minimizing or reducing the overall size of the vending machine.

Typically, a bucket includes an elongated body portion that is at least somewhat cylindrically shaped. The body portion includes an inside surface that forms a channel that extends longitudinally along the body portion between a pair of opposing end walls. The bucket is typically supported within the vending machine on each of the end walls. A bearing surface is often provided on each end wall for engaging the vending machine. Additionally, suitable features can be provided on one of the end walls for transmitting rotational motion from a motor or other actuator located within the vending machine.

The buckets are typically disposed horizontally within a vending machine and must be sufficiently rigid to support the force of two or more beverage containers falling vertically from above into the bucket. Additionally, a torsional load is also applied to the bucket as the same rotates to dispense the individual beverage containers. As such, the bucket must have sufficient torsional rigidity to withstand any such load. Due to the desired thin-walled construction discussed above, buckets molded from polymeric materials have been found to have insufficient rigidity. For this and other reasons, buckets are typically manufactured out of metallic materials, such as zinc or aluminum. Buckets manufactured from zinc are typically die cast, while buckets made of aluminum are commonly extruded with end walls attached thereto, such as by welding, for example.

Die cast zinc buckets suffer from a number of disadvantages that tend to increase costs of the part and can also result in reduced quality. One such disadvantage is the extensive lead time that is commonly required for die casting such parts. It is well understood that longer lead times limit the manufacturers ability to react to market or customer demands.

Additionally, die casting tooling tends to wear significantly under production use, especially in areas of the tooling that produce tightly toleranced parts. As such, significant repair costs are often associated with maintaining die cast tooling in condition to produce such tightly toleranced parts. Furthermore, even with such maintenance of the tooling, die cast parts commonly require secondary operations to produce a finished part. For example, certain features of die cast buckets are typically re-struck to finished dimensions and/or conditions after the die casting process. This further adds to the cost, as well as the already substantial lead time for die cast buckets.

Aluminum buckets are typically manufactured by extruding the elongated body portion out of a suitable aluminum material. A pair of opposing end walls are then attached to the ends of the elongated body portion. Usually, the end walls are also formed from aluminum, and are manufactured in any suitable manner, such as being machined from bar stock, for example. The end walls can be attached to the elongated body portion in any suitable manner, however, welding is typically used. Aluminum buckets tend to suffer from the disadvantages similar to those discussed above. Namely, aluminum buckets are typically expensive to manufacture. This is due, at least in part, to material costs as well as the costs associated with secondary operations, such as machining and welding operations. As such, it is desirable to develop a bucket having the desired strength and rigidity but, also, that is efficient and economical to manufacture.

SUMMARY OF THE INVENTION

In accordance with the present invention, a stamped bucket for a vending machine is provided that avoids or minimizes the problems and disadvantages encountered in connection with buckets of the foregoing character while promoting a desired simplicity of structure and economy of manufacture.

More particularly in this respect, a stamped bucket is provided that includes an elongated body having opposing first and second ends. A first end wall is integrally formed on the body along the first end and extends in generally transverse relation to the same. The first end wall has a first tab portion extending therefrom that is secured to the body adjacent the first end. A second end wall is also integrally formed on the body along the second end thereof. The second end wall also extends in a generally transverse relation to the body, and an axis of rotation extends between the first and second end walls in substantial alignment with the body. The second end wall has a second tab portion that extends therefrom and is secured to the body adjacent the second end.

Additionally, a method of forming a bucket from a sheet of metal is provided that includes the step of forming a blank on the sheet of metal. The blank includes an elongated body portion having first and second opposing ends, a first end wall portion integrally formed on the first end of the body, and a second end wall portion integrally formed on the second end of the body. Additionally, a first elongated tab extends from one of the first body portion and the first end wall portion, and a second elongated tab extends from one of the body portion and the second end wall portion. Another step includes forming the first and second end wall portions generally transverse the elongated body portion. Still other steps include forming the first tab adjacent the other of the body portion and the first end wall portion, and forming the second tab adjacent the other of the body portion and the second end wall portion. Further steps include attaching the first tab to the other of the body portion and the first end wall portion, and attaching the second tab to the other of the body portion and the second end wall portion.

Furthermore, a stamped bucket is provided that is manufactured in accordance with the foregoing method.

DETAILED DESCRIPTION OF THE INVENTION

Figure 1:
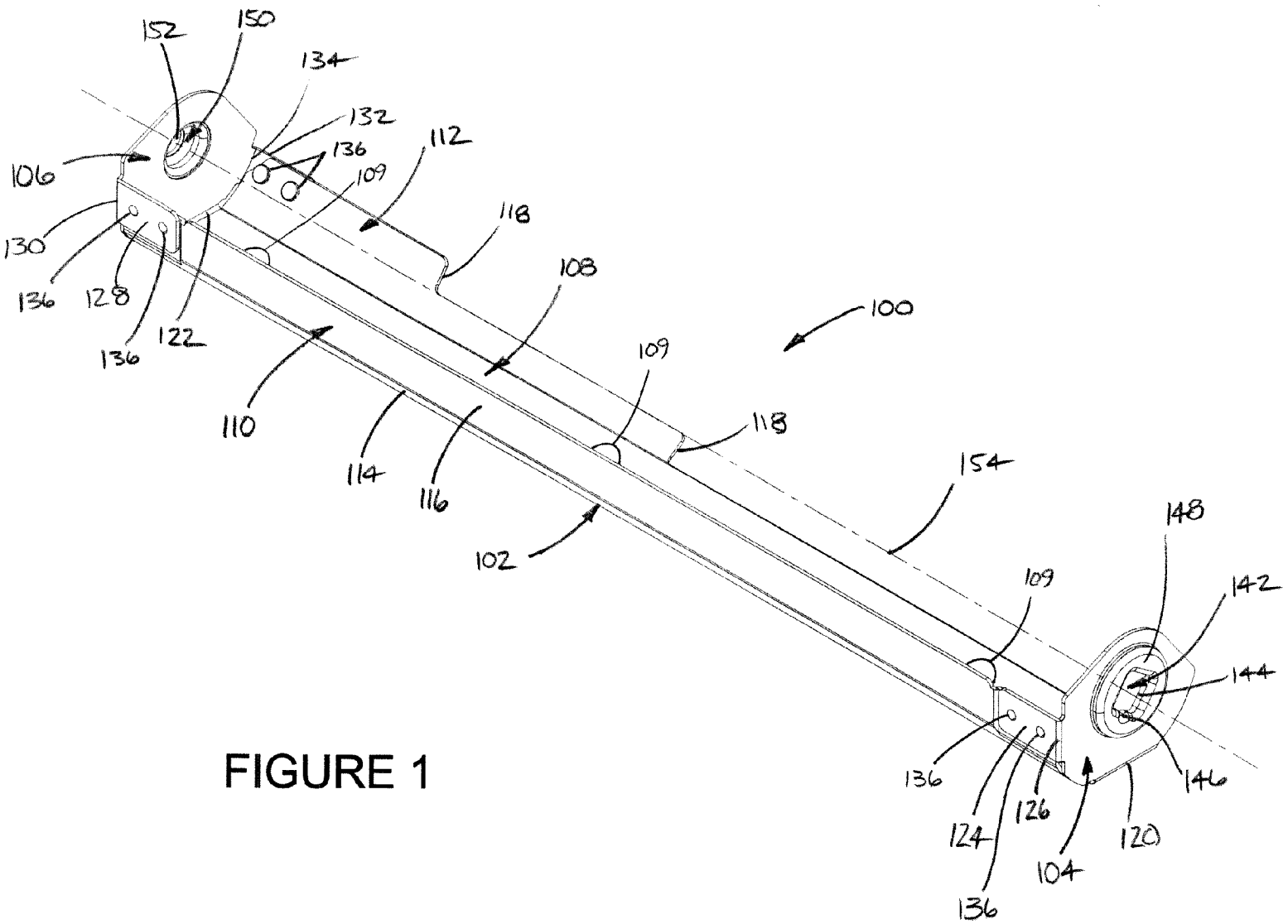
FIG. 1 is a perspective view of a stamped bucket in accordance with the present invention.
Figure 2:
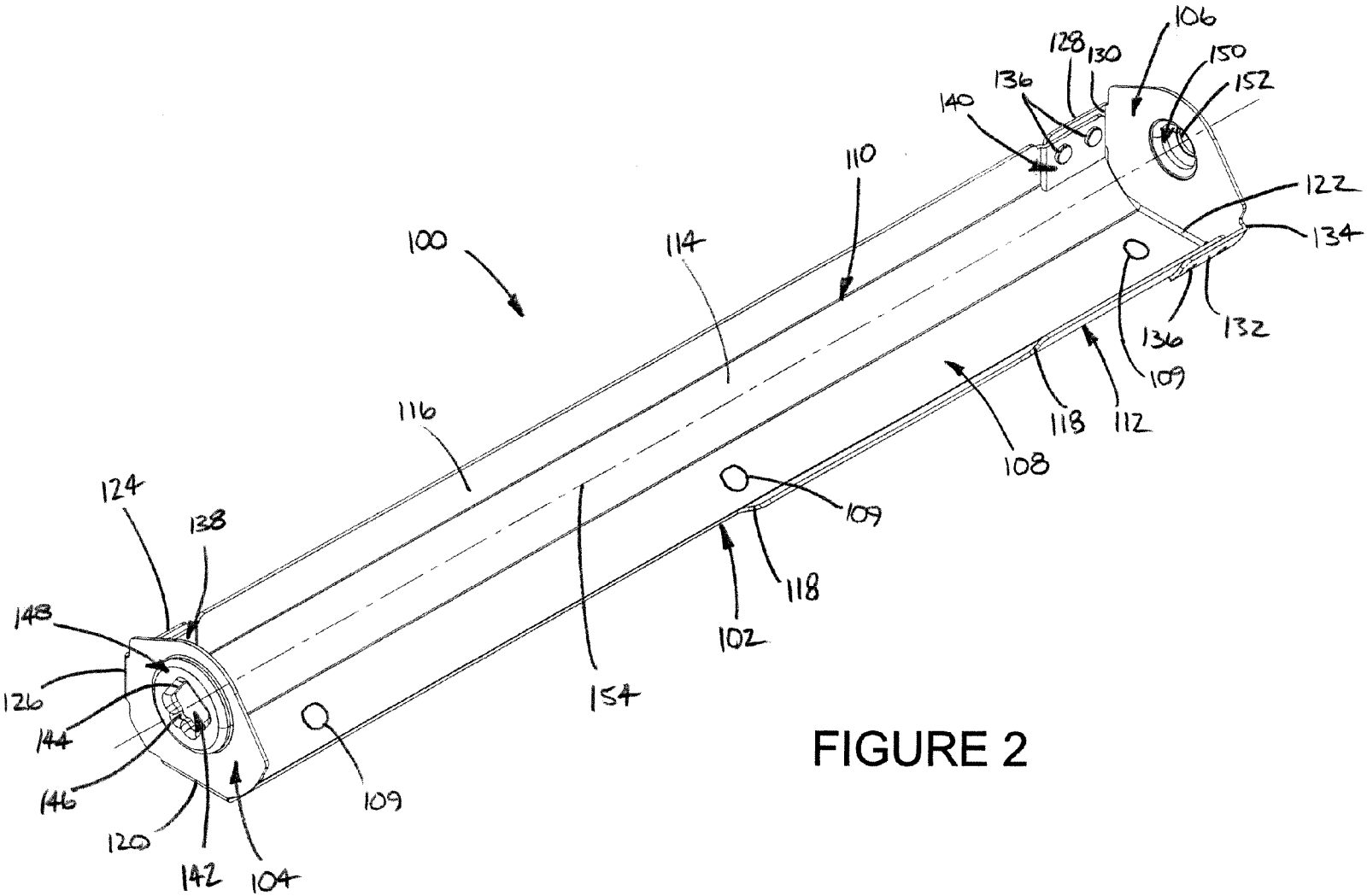
FIG. 2 is another perspective view of the stamped bucket shown in FIG. 1.

Referring now in greater detail to the drawings, wherein the showings are for the purpose of illustrating preferred embodiments of the invention only, and not for the purpose of limiting the invention, FIGS. 1 and 2 illustrate a bucket 100 having an elongated body 102 and opposing end walls 104 and 106. Elongated body 102 is shown in FIGS. 1 and 2 as having a generally planar bottom wall portion 108 and side wall portions 110 and 112 extending generally opposite one another from bottom wall portion 108. Holes 109 are provided on bottom wall portion 108. Such holes can be used for drainage of fluids collecting on bottom wall portion 108, for example. Side wall portion 110 is faceted and includes a lower curvilinear section 114 extending from bottom wall portion 108 and an upper planar section 116. In the present embodiment, side wall portion 112 is shown as being substantially curvilinear. However, it will be appreciated that buckets commonly take various forms, shapes, sizes, lengths and configurations. As such, any suitable shape or form of wall portions 108, 110 and 112 can be used without departing from the scope and intent of the present invention. In the present embodiment, a plurality of notches or steps 118 have been included on side wall portion 112. However, it will be appreciated that the inclusion of such steps is optional.

End walls 104 and 106 extend in generally transverse relation to elongated body 102. Each of the end walls are integrally formed from the material forming elongated body 102 and are respectively connected thereto at corners 120 and 122. The corners are shown as being approximately the same width as bottom wall portion 108 and integrally connect the end walls to the same. It will be appreciated, however, that any suitable size, shape or configuration of these corners can be used. End wall 104 includes an elongated tab 124 extending therefrom. The tab is folded or bent out of the plane of end wall 104 forming a corner 126. Preferably, tab 124 is substantially aligned with elongated body 102 such that the tab is in abutting engagement with side wall portion 110 of the body. Similarly, an elongated tab 128 extends from end wall 106 forming a corner 130 therebetween. Preferably, tab 128 extends in substantial alignment with body 102 and is in abutting engagement with side wall portion 110. Another elongated tab 132 extends from end wall 106 forming a corner 134. Tab 132 preferably extends in substantial alignment with body 102 and is in abutting engagement with side wall portion 112. It will be appreciated that in other embodiments, one or more of the tabs can extend from the side wall portion, or other portions of the elongated body, and abuttingly engage the end walls. Such embodiments are distinctly intended to be included within the scope and intent of the present invention.

Each of tabs 124, 128 and 132 are secured to elongated body 102 using a suitable manner of joining or attachment, including fastening, such as by rivets, screws or bolts, for example, and/or joining, such as by welding, for example. In one preferred embodiment, the tabs are attached to respective side wall portions of the elongated body by using an upset-pressing style fastener. One such fastener that is suitable for the present application is sold under the designation or trademark TOX by Tox Pressotechnik GmbH & Co. KG of Weingarten, Germany. As shown in FIGS. 1 and 2, two TOX joints 136 are used on each of tabs 124, 128 and 132 to attach the same to elongated body 102. It will be appreciated, however, that any suitable number of TOX joints or other fasteners or fastening or joining arrangements can be used without departing from the principles of the present invention. Additionally, upper planar section 116 of side wall portion 110 includes two offset areas 138 and 140 respectively adjacent tabs 124 and 128. The offset areas extend inwardly from the upper planar section a sufficient distance to accommodate the associated tabs. As such, the outside surface of each tab can be substantially aligned with the outside surface of side wall portion 110. It will be appreciated that the use of offset areas is optional and depends on the shape, size and configuration of the bucket, as well as the structural relation between the same and other surrounding parts of a vending machine. For example, side wall portion 112 does not include an offset area adjacent tab 132, as can be seen in FIG. 2.

A boss 148 projects outwardly from end wall 104. The boss is shown in FIGS. 1 and 2 as being substantially circular. However, it will be appreciated that any suitable shape or configuration can be used. Additionally, end wall 104 includes an opening 142 extending therethrough that includes a plurality of inside walls 144 and a radially outwardly extending locating feature 146. As mentioned above, the bucket is rotated during vend operations, and the vending machine includes a motor or other actuator operatively associated with the bucket and engaging opening 142 to transmit rotational motion to the bucket. As such, opening 142 is shown as being non-circular to transmit such motion. It will be appreciate, however, that any feature or arrangement of features suitable for transmitting such rotary motion can be used.

End wall 106 includes a boss 150 projecting therefrom. Boss 150 is shown in FIGS. 1 and 2 as being substantially cylindrical and has an opening 152 extending therethrough. Bosses 148 and 150 are substantially coaxially aligned with one another define an axis 154 extending along bucket 100 about which the same rotates when in use on a vending machine. It will be appreciated that the elongated body in conjunction with the end walls form a channel or cavity (not numbered) suitable for supporting and retaining vended products, such as beverage containers, for example.

FIGS. 3-21 illustrate various steps, operations or other processes that can be utilized to form a stamped bucket in accordance with the present invention. Various areas, details and/or features of the bucket are formed, in whole or in part, in one or more of the steps. As such, the discussion of FIGS. 3-21 hereinafter will typically make reference to those features or characteristics being created or modified by the step or process under discussion. It will be appreciated that various intermediate forms of the finished features may be produced in certain steps of the forming process, and that such intermediate forming steps are intended to be optionally included.

Figure 3:
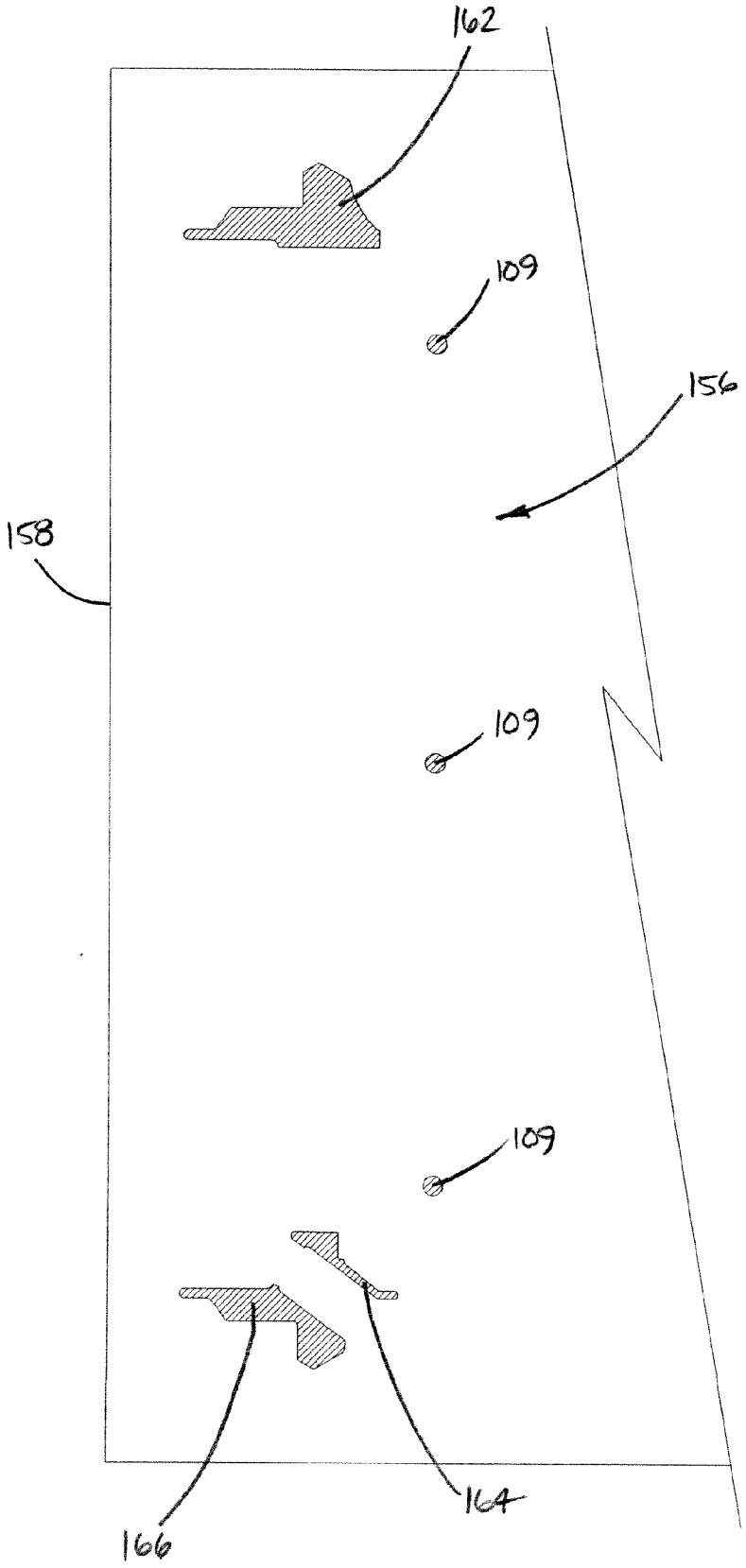
FIG. 3 is a top plan view of a sheet of metal illustrating one step in forming the stamped bucket shown in FIG. 1.

FIG. 3 shows a strip or sheet of material 156 having a leading edge 158 that will be progressively moved through a die set or other suitable arrangement (not shown) for forming a stamped bucket in accordance with the present invention. Initially, steps or operations, such as those shown in FIGS. 3-5, can be used to form a bucket blank 160 (FIG. 5) from the sheet of material. The bucket blanks move progressively through the die arrangement (not shown) to form a stamped bucket in accordance with the present invention.

Figure 4:
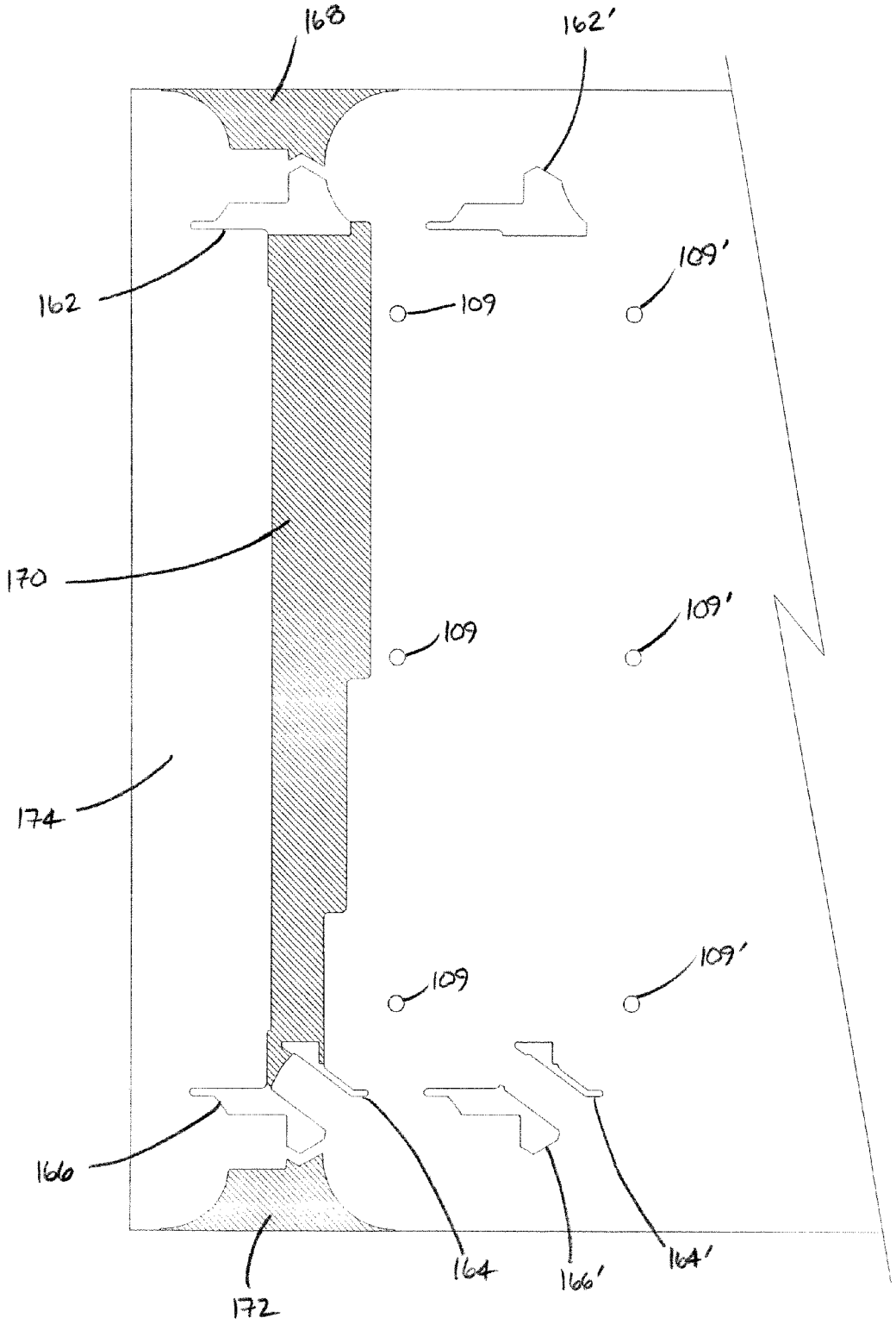
FIG. 4 is a top plan view of the sheet of metal shown in FIG. 3 illustrating another step in forming the stamped bucket shown in FIG. 1.

At a first stage, a plurality of passages, such as holes 109 are formed on sheet 156. Additionally, areas 162, 164 and 166 are removed from the sheet of material. Preferably, these areas are formed by a stamping-type operation. However, other methods of removing these areas can be used, such as laser cutting, for example. In a next step or stage, shown in FIG. 4, areas 168, 170 and 172 are similarly removed from the sheet of material. It will be appreciated that original areas 160, 162 and 164 provide various aspects and portions of the features that form blank 160, and that such features can include intermediate forms as mentioned above. As can be seen in FIG. 4, as holes 109 and areas 162, 164 and 166 are formed at the stage removing areas 168, 170 and 172, holes 109' and areas 162', 164' and 166' are preferably simultaneously formed at the first stage shown in FIG. 3. It will be further appreciated from FIG. 4 that partial blank 174 that includes leading edge 158 will be unsuitable for the formation of a bucket in accordance with the present invention.

Figure 5:
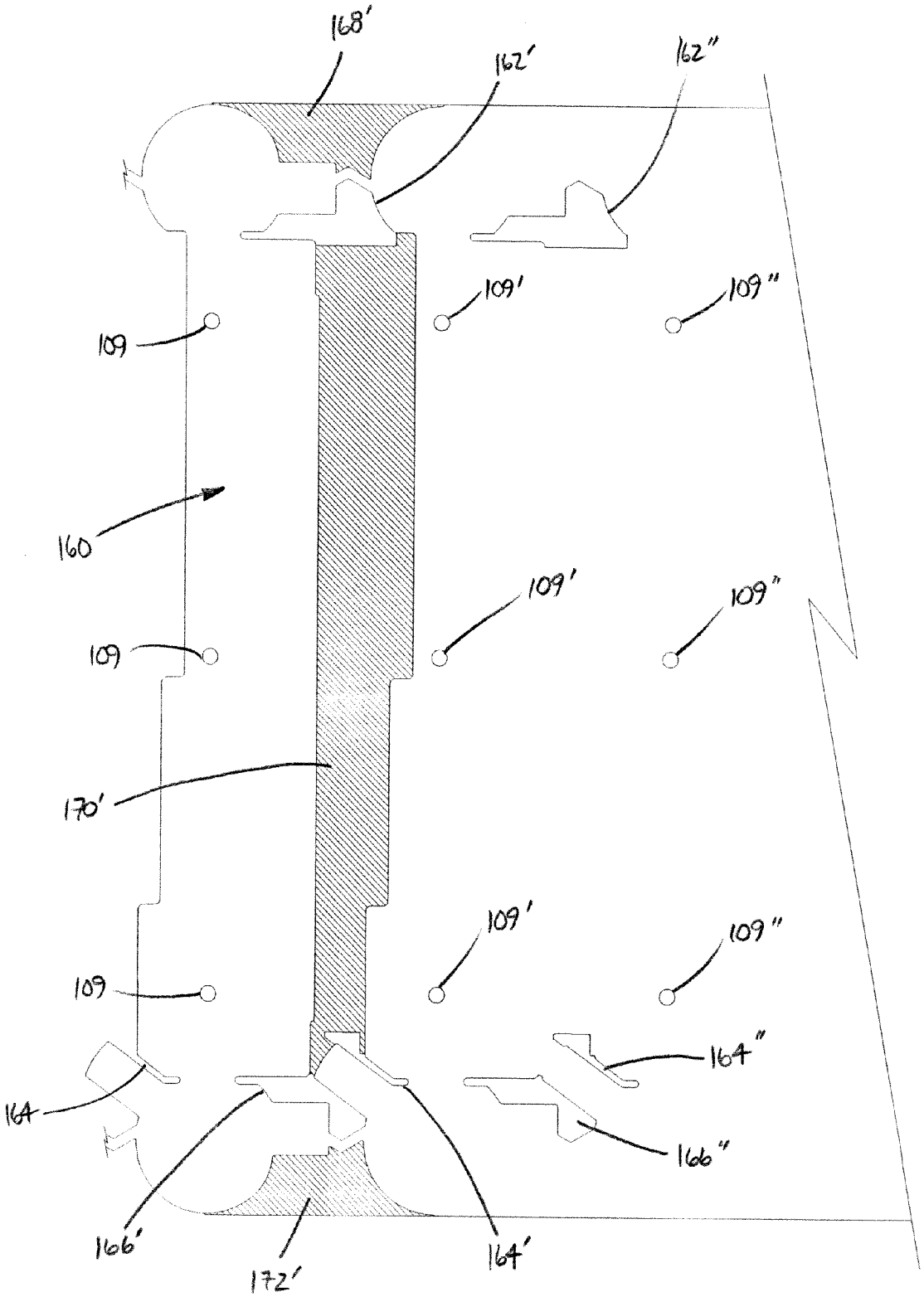
FIG. 5 is a top plan view of the sheet of metal shown in FIG. 4 illustrating another step in forming the stamped bucket shown in FIG. 1.

Turning now to FIG. 5, bucket blank 160 includes holes 109 and is formed in part by area 164, areas 162' and 166', as well as areas 168' 170' and 172' that are being formed in this stage. Additionally, it will be appreciated that holes 109" have been formed at the first stage, along with areas 162", 164" and 168". It will be appreciated that the drawings and discussion thereof will primarily refer to blank 160. However, it will be appreciated that a series of blanks will be progressively formed and moved through the die arrangement without further reference to primes (') and double primes (") and that the primed and double primed features and areas are so labeled solely to indicate relative position to one another and should not be construed as in any way limiting, altering or otherwise differentiating these features and areas.

Figure 6:
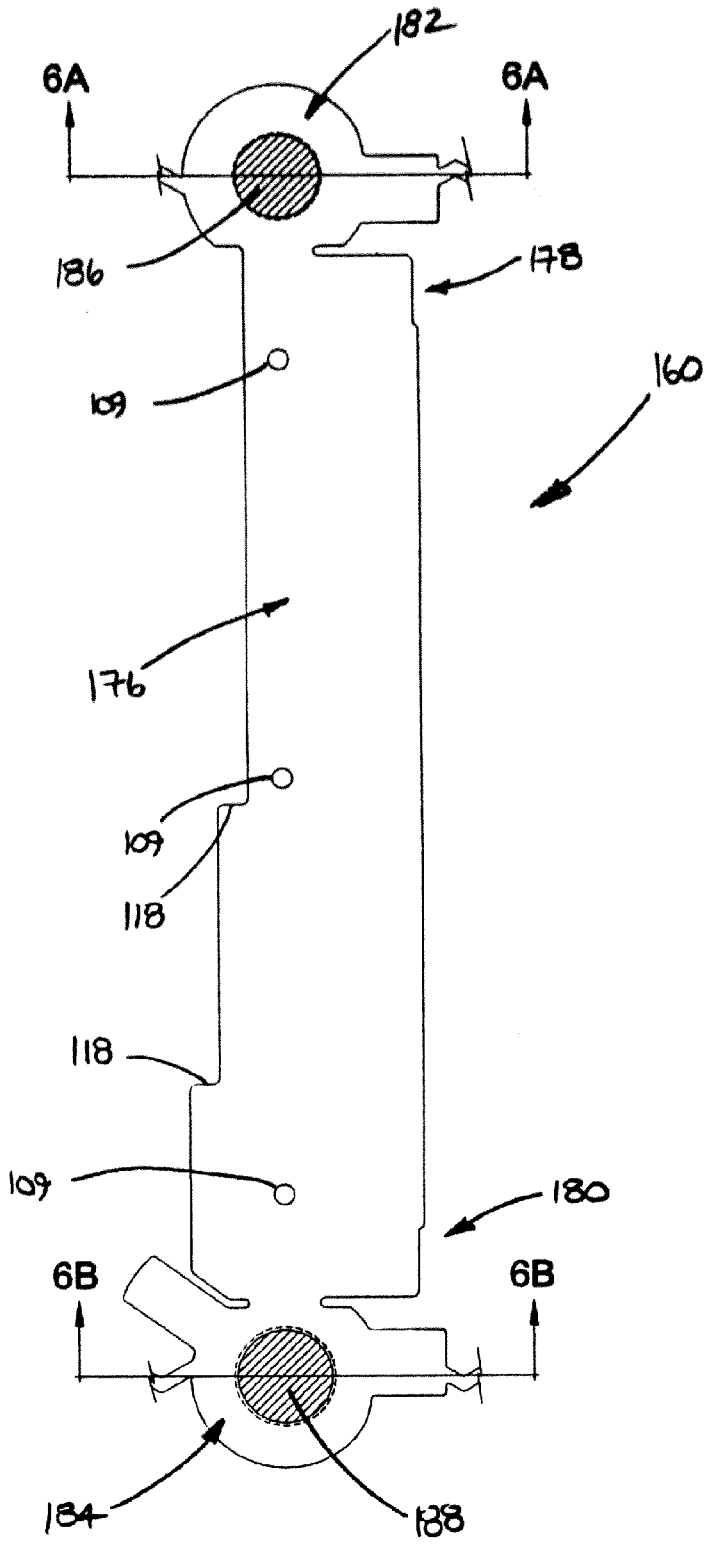
FIG. 6 is a top plan view of a portion of the sheet of metal shown in FIG. 5 illustrating another step in forming the stamped bucket shown in FIG. 1.
Figure 6A:
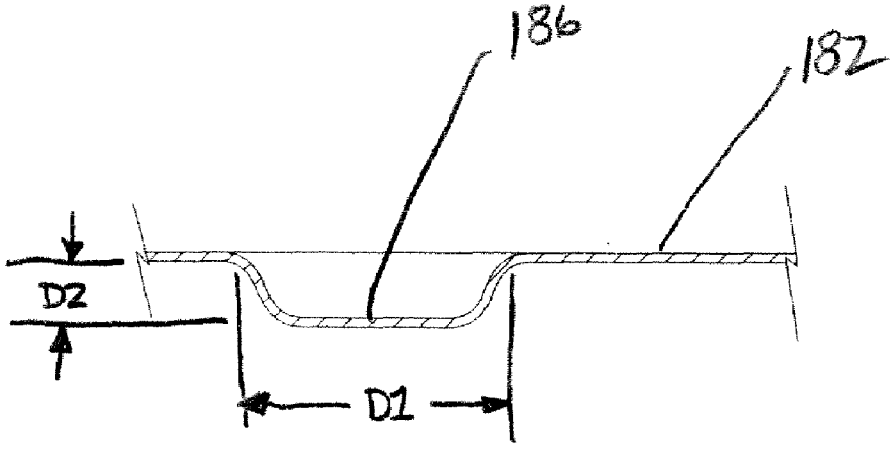
FIG. 6A is a side elevation view, shown in cross section, of the portion of the sheet of metal shown in FIG. 6 taken along line 6A-6A.
Figure 6B:
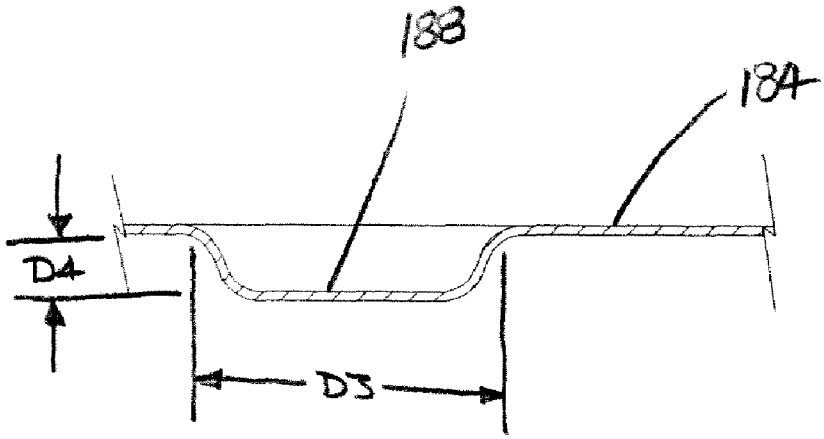
FIG. 6B is a side elevation view, shown in cross section, of the portion of the sheet of metal shown in FIG. 6 taken along line 6B-6B.

FIG. 6 illustrates a bucket blank 160 having a plurality of holes 109 provided on an elongated body portion 176 that has opposing ends 178 and 180. Integrally formed on blank 160 are end wall portions 182 and 184. It will be appreciated that elongated body portion 176 is ultimately formed into body 102 of bucket 100 and, likewise, end wall portions 182 and 184 are respectively formed into end walls 104 and 106. It will be further appreciated that steps 118 of side wall portion 112 are provided on blank 176 due to the operations shown in and described with regard to FIGS. 4 and 5. As shown in FIGS. 6A and 6B, areas 186 and 188 respectively on end wall portions 182 and 184 are formed at this stage. Area 186 is shown in FIG. 6A as having a diameter dimension D1 and a depth dimension D2. Additionally, as shown in FIG. 6B, area 188 has a diameter dimension D3 and a depth dimension D4.

Figure 7:
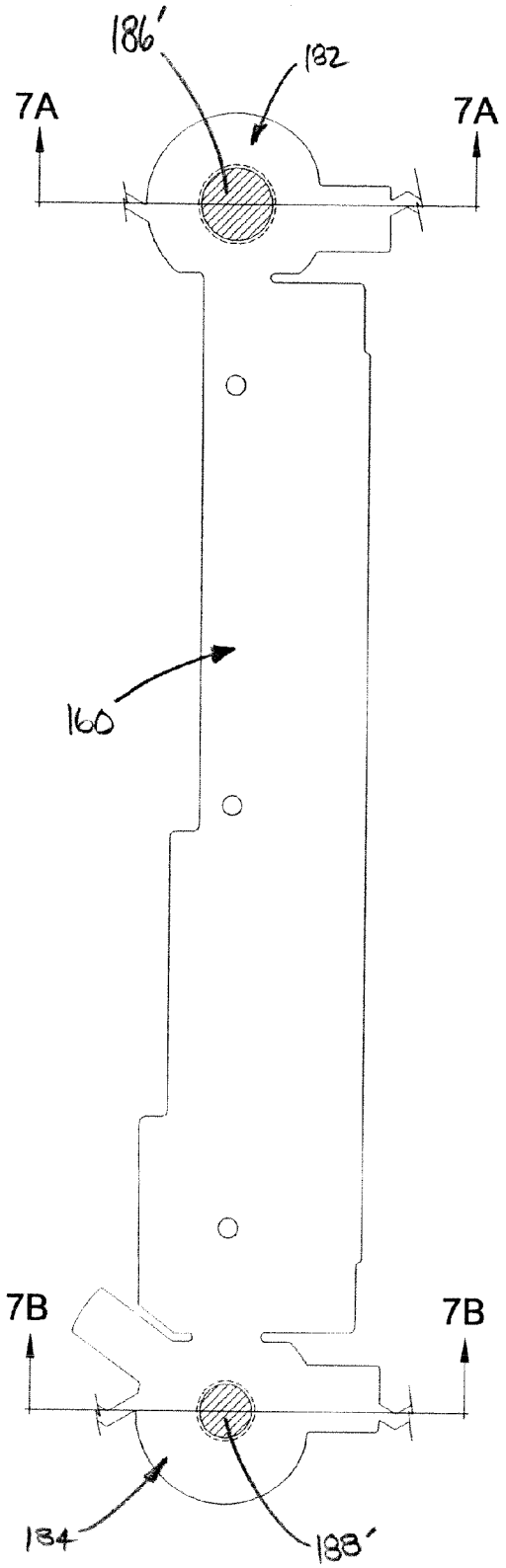
FIG. 7 is a top plan view of the portion of the sheet of metal shown in FIG. 6 illustrating another step in forming the stamped bucket shown in FIG. 1.
Figure 7A:
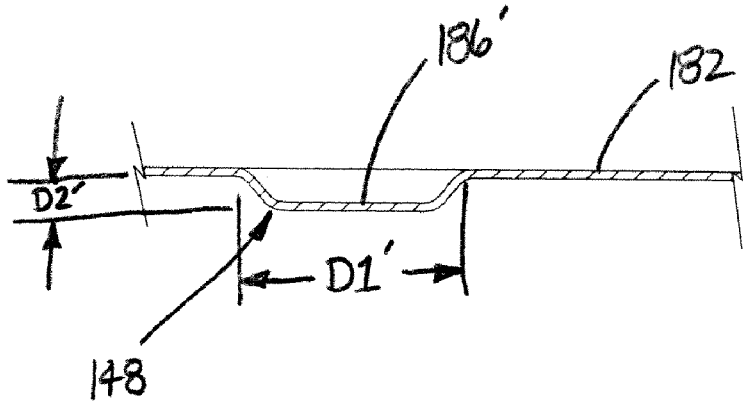
FIG. 7A is a side elevation view, shown in cross section, of the portion of the sheet of metal shown in FIG. 7 taken along line 7A-7A.
Figure 7B:
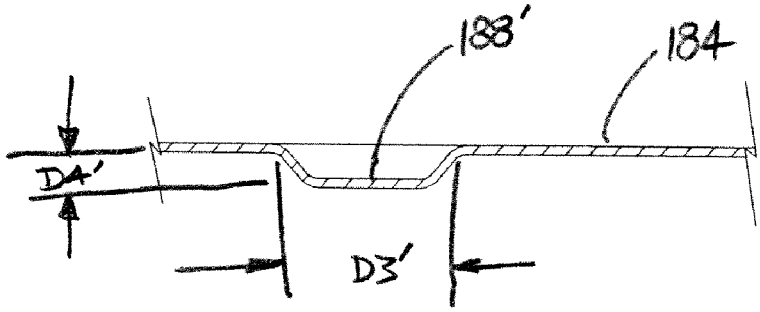
FIG. 7B is a side elevation view, shown in cross section, of the portion of the sheet of metal shown in FIG. 7 taken along line 7B-7B.

Turning now to FIGS. 7, 7A and 7B, end wall portions 182 and 184 of bucket blank 160 are further formed in this step or stage to respectively include areas 186' and 188'. As shown in FIG. 7A, area 186' has a diameter dimension of D1' and a depth dimension of D2'. Preferably, dimensions D1' and D2' are less than dimensions D1 and D2 shown in and described with regard to FIG. 6A. Additionally, area 188' has a diameter dimension of D3' and depth dimension of D4'. Again, dimensions D3' and D4' are preferably less than dimensions D3 and D4 shown in and described with regard to FIG. 6B. It will be appreciated that the forming of area 186' at this stage substantially completes the formation of boss 148.

Figure 8:
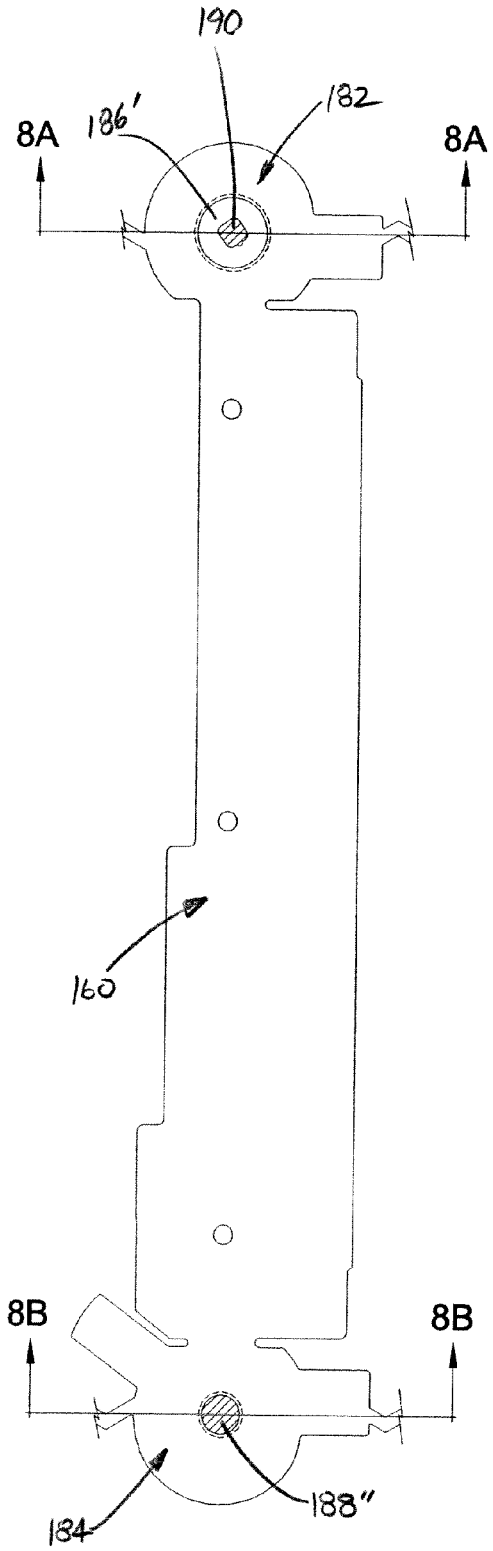
FIG. 8 is a top plan view of the portion of the sheet of metal shown in FIG. 7 illustrating another step in forming the stamped bucket shown in FIG. 1.
Figure 8A:
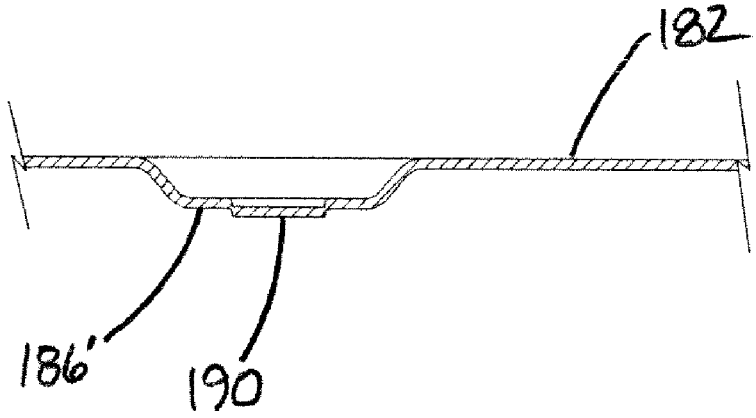
FIG. 8A is a side elevation view, shown in cross section, of the portion of the sheet of metal shown in FIG. 8 taken along line 8A-8A.
Figure 8B:
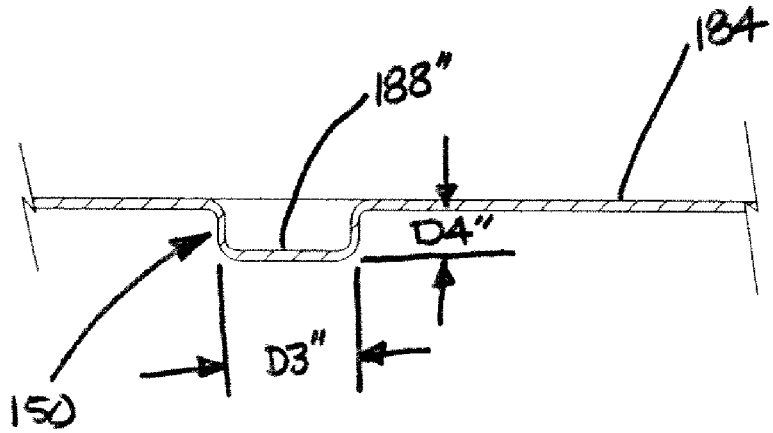
FIG. 8B is a side elevation view, shown in cross section, of the portion of the sheet of metal shown in FIG. 8 taken along line 8B-8B.

FIG. 8 shows area 186' of end wall portion 182 being further formed in this step or stage to include area 190, which is coined or deformed from area 186', as shown in FIG. 8A. Additionally, end wall portion 184 is further formed to include area 188" having a diameter dimension of D3" and a depth dimension of D4", as shown in FIG. 8B, substantially completing the formation of boss 150. Preferably, dimension D3" is less than dimension D3' shown in and described with regard to FIG. 7B. Furthermore, dimension D4" is preferably greater than dimension D4' shown in and described with regard to FIG. 7B.

Figure 9:
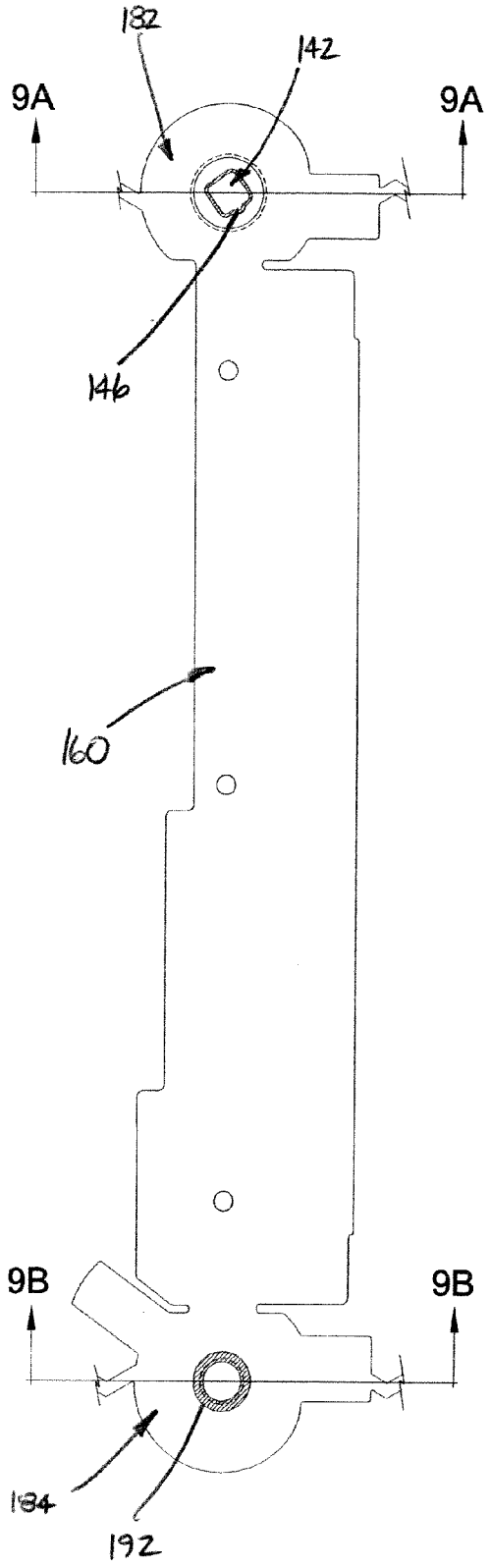
FIG. 9 is a top plan view of the portion of the sheet of metal shown in FIG. 8 illustrating another step in forming the stamped bucket shown in FIG. 1.
Figure 9A:
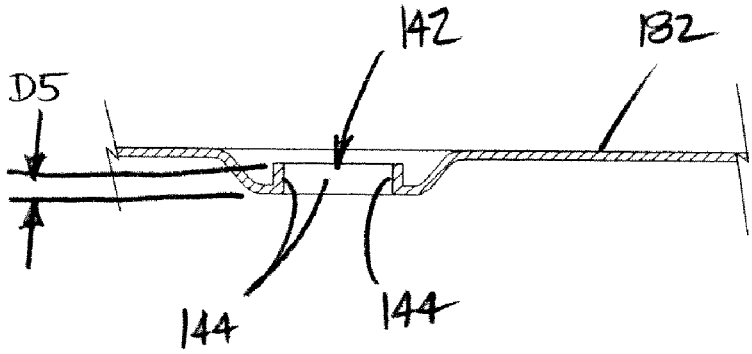
FIG. 9A is a side elevation view, shown in cross section, of the portion of the sheet of metal shown in FIG. 9 taken along line 9A-9A.
Figure 9B:
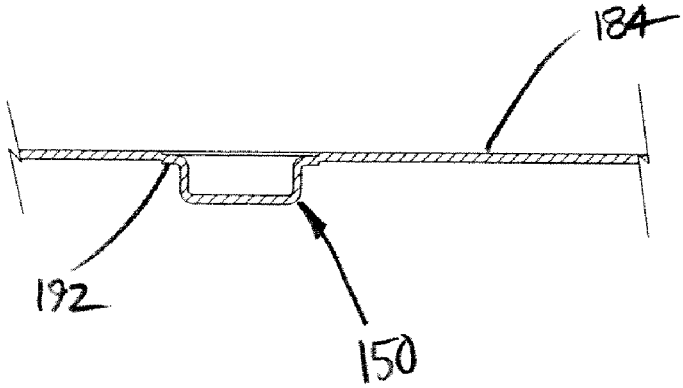
FIG. 9B is a side elevation view, shown in cross section, of the portion of the sheet of metal shown in FIG. 9 taken along line 9B-9B.

In FIGS. 9, 9A and 9B, opening 142 is formed on end wall portion 182 of bucket blank 160. On end wall portion 184 of bucket blank 160, a downwardly displaced or coined area 192 is formed adjacent boss 150. As shown in FIG. 9A, opening 142 includes a plurality of inside walls 144 and a locating feature 146 (FIG. 9). It will be appreciated that inside walls 144 have a dimension D5 that is preferably less than dimension D2' shown in FIG. 7A.

It is to be specifically understood that the foregoing discussion of the various dimensions and features shown in and described with regard to FIGS. 6A, 6B, 7A, 7B, 8A, 8B, 9A and 9B, along with the shapes and configurations of the other features disclosed herein, are simply illustrative of one embodiment of the present invention. As such, buckets in accordance with the present invention are not intended to be constrained or in any other way limited to the configurations shown and described herein.

Figure 10:
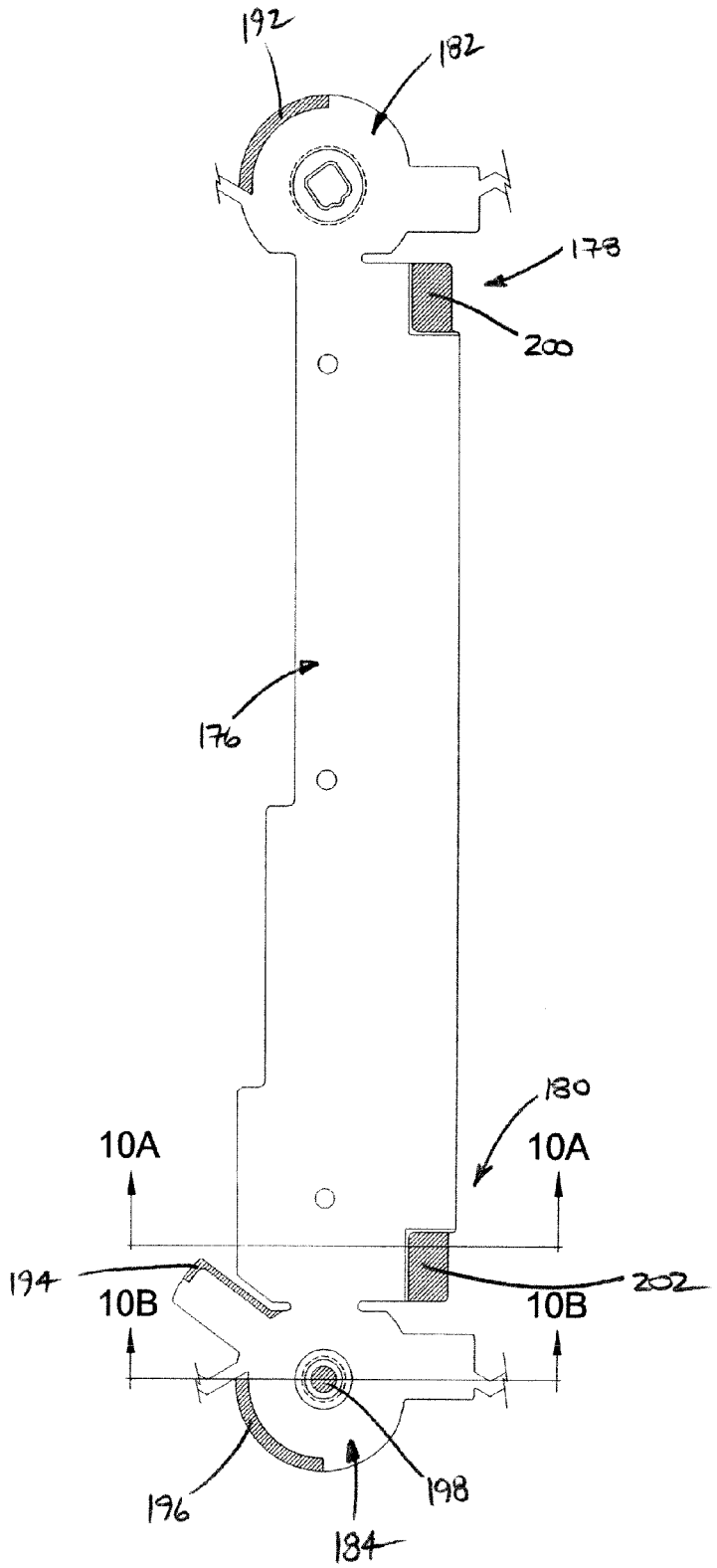
FIG. 10 is a top plan view of the portion of the sheet of metal shown in FIG. 9 illustrating another step in forming the stamped bucket shown in FIG. 1.
Figure 10A:
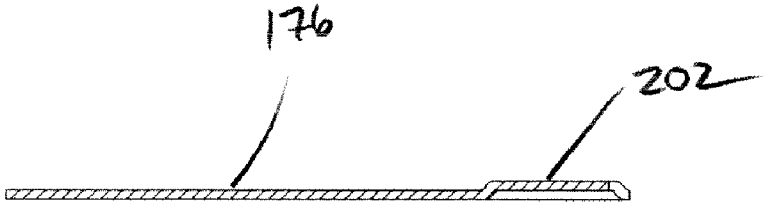
FIG. 10A is a side elevation view, shown in cross section, of the portion of the sheet of metal shown in FIG. 10 taken along line 10A-10A.
Figure 10B:
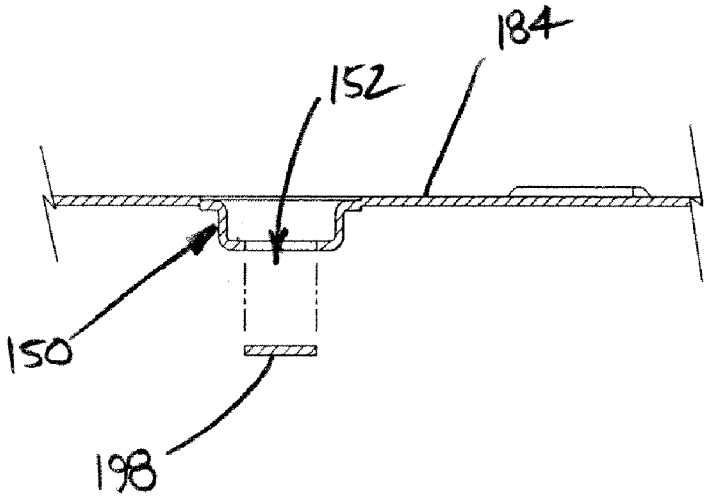
FIG. 10B is a side elevation view, shown in cross section, of the portion of the sheet of metal shown in FIG. 10 taken along line 10B-10B.

FIG. 10 illustrates a further step or stage in which area 192 is trimmed or otherwise removed from end wall portion 182. Additionally, areas 194 and 196 are trimmed or otherwise removed from end wall portion 184. Opening 152 is formed through boss 150 by piercing or otherwise removing area 198, as shown in FIG. 10B. Furthermore, areas 200 and 202 respectively on ends 178 and 180 of body portion 176 are displaced upwardly from the body portion, as shown in FIG. 10A, to respectively form offset areas 138 and 140 shown in FIG. 2. It will be appreciated that areas 200 and 202 are optional, as mentioned above, and can alternately be displaced downwardly or take any other suitable form or configuration.

Figure 11:
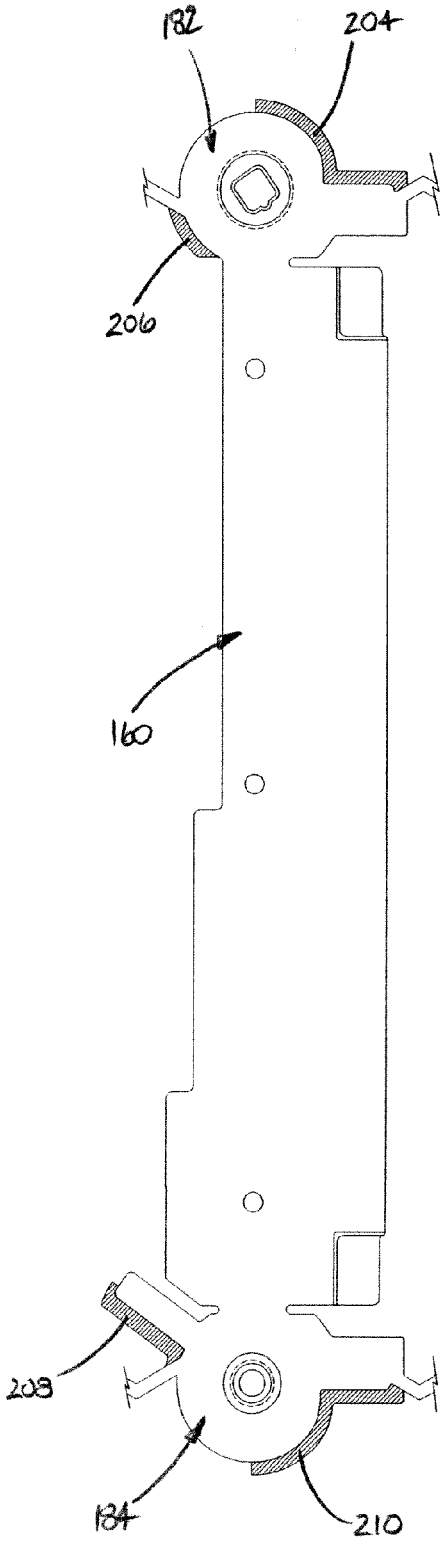
FIG. 11 is a top plan view of the portion of the sheet of metal shown in FIG. 10 illustrating another step in forming the stamped bucket in FIG. 1.
Figure 12:
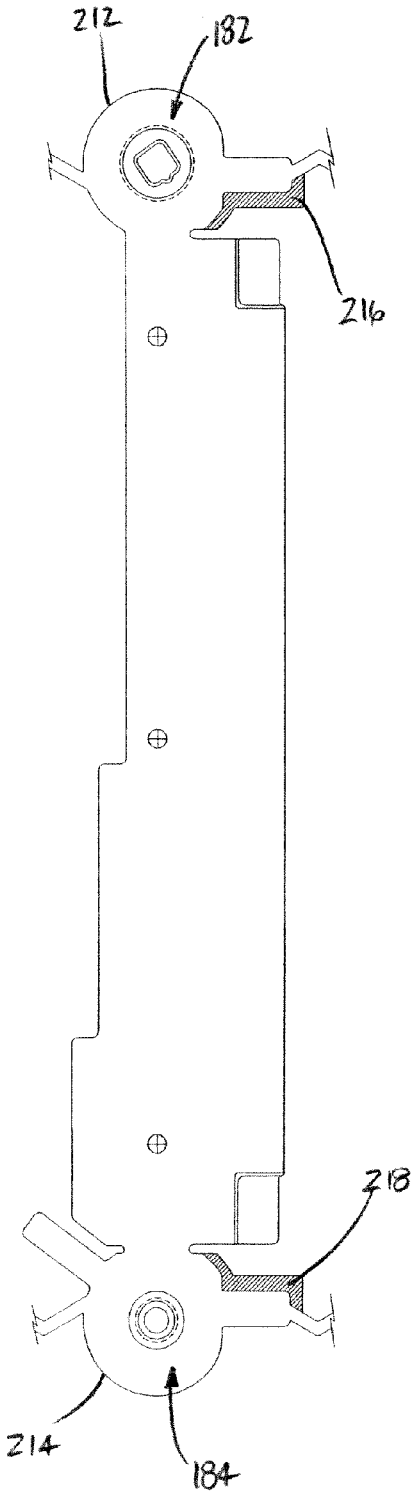
FIG. 12 is a top plan view of the portion of the sheet of metal shown in FIG. 11 illustrating another step in forming the stamped bucket shown in FIG. 1.

Turning now to FIGS. 11 and 12, end wall portion 182 of bucket blank 160 is further modified in this step or stage by trimming or otherwise removing areas 204 and 206 therefrom. On end wall portion 184, areas 208 and 210 are likewise trimmed or otherwise removed. The formation of tab 132 is substantially completed by the removal of area 208. Additionally, peripheral edges 212 and 214, respectively of end wall 182 and 184, are substantially formed, as shown in FIG. 12. During a step or stage shown in FIG. 12, areas 216 and 218 are respectively trimmed or otherwise removed from end wall portions 182 and 184 substantially forming tabs 124 and 128, respectively. Additional steps, such as coining or otherwise breaking edges of the bucket blank, can optionally be performed at this or other stages, as desired.

Figure 13:
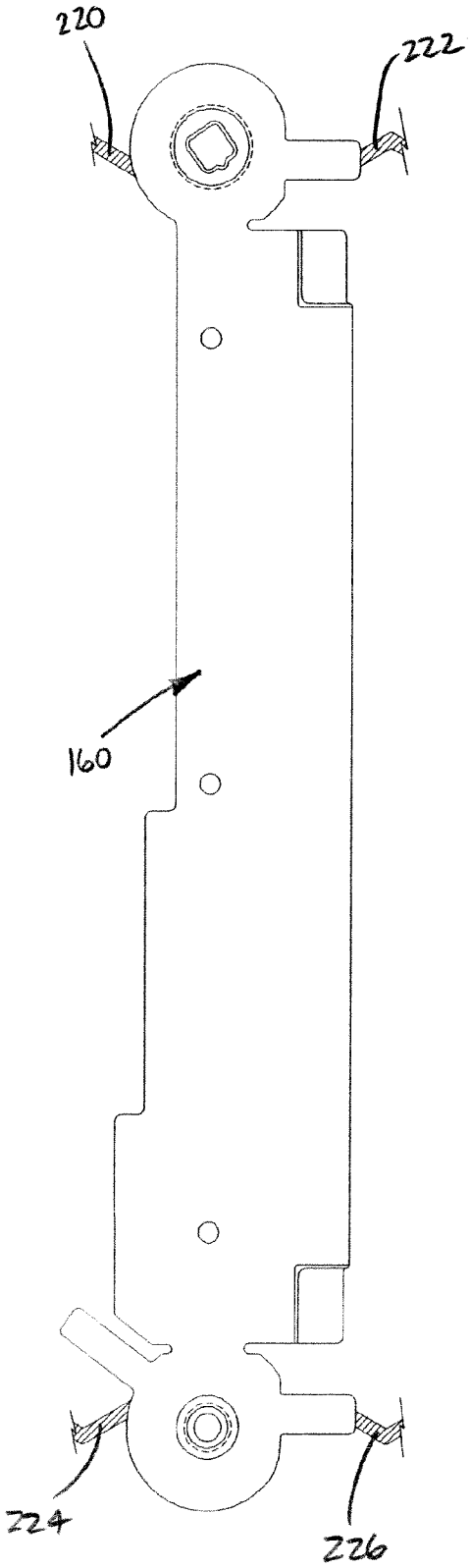
FIG. 13 is a top plan view of the portion of the sheet of metal shown in FIG. 12 illustrating another step in forming the stamped bucket shown in FIG. 1.
Figure 14:
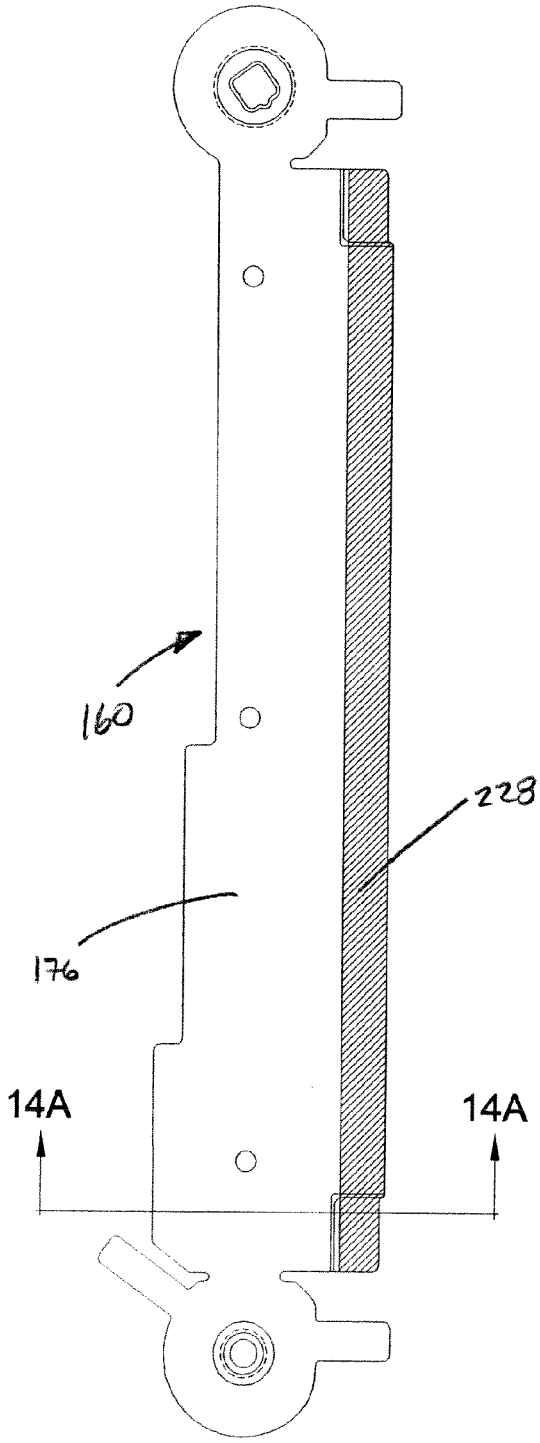
FIG. 14 is a top plan view of the portion of the sheet of metal shown in FIG. 13 illustrating another step in forming the stamped bucket shown in FIG. 1.
Figure 14A:
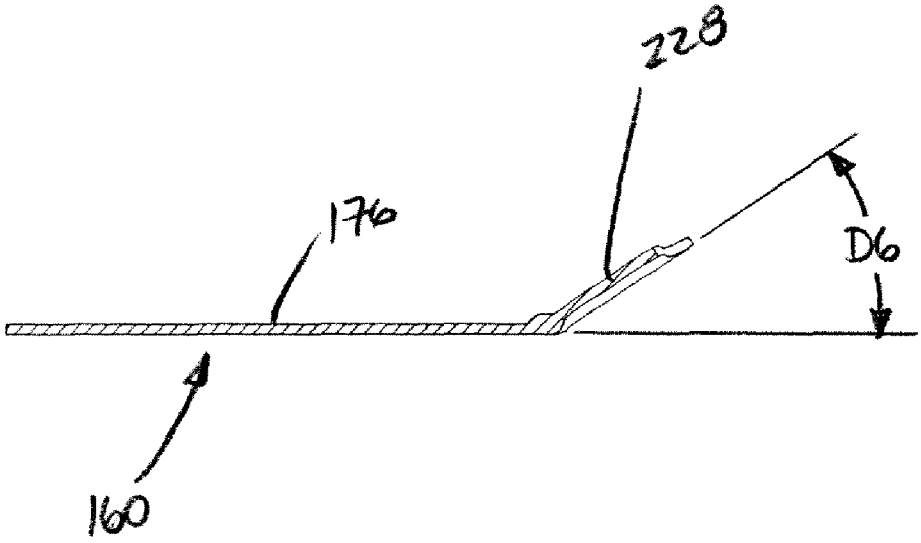
FIG. 14A is a side elevation view, shown in cross section, of the portion of the sheet of metal shown in FIG. 14 taken along line 14A-14A.

In FIGS. 13-14, various steps and/or operations are illustrated. It will be appreciated that one or more of these steps can be performed simultaneously during a single stage on the die arrangement (not shown). FIG. 13 illustrates bucket blank 160 having connector areas 220, 222, 224 and 226 trimmed or otherwise removed from end wall portions 182 and 184. As such, in this stage or operation, bucket blank 160 is made to be independent from the strip of bucket blanks formed from sheet of material 156. If the operation shown in FIGS. 14 and 14A are done separately from that shown in FIG. 15, bucket blank 160 is transferred to the next stage of the die arrangement (not shown) to bend or otherwise deform area 228 at an angle from the remainder of body portion 176. Ultimately, area 228 will become upper planar section 116 of side wall portion 110. As shown in FIG. 14A, area 228 is formed upwardly at an angle D6. It will be appreciated that angle D6 can extend through any angle or range of angles, up or down, that is suitable for providing the final fit, form and function of the elongated body and end walls, depending on the desired size, shape and configuration of the resulting stamped bucket. For example, angle D6 is shown in FIG. 14A at about 35 degrees.

Figure 15:
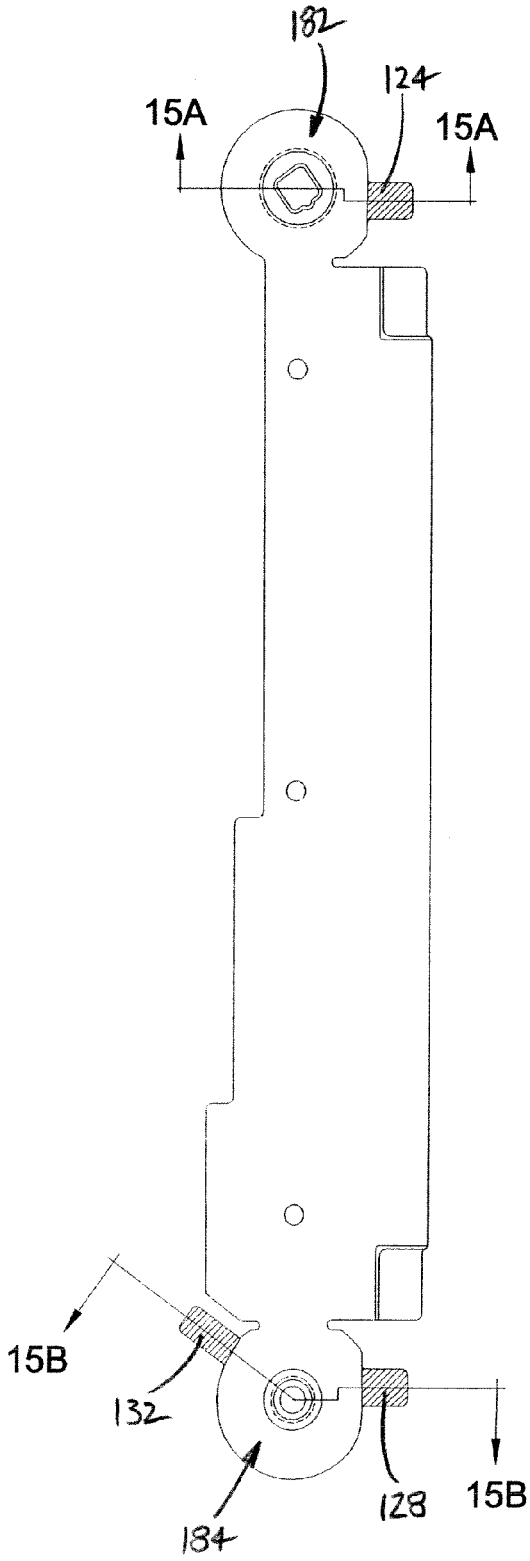
FIG. 15 is a top plan view of the portion of the sheet of metal shown in FIG. 14 illustrating another step in forming the stamped bucket shown in FIG. 1.
Figure 15A:
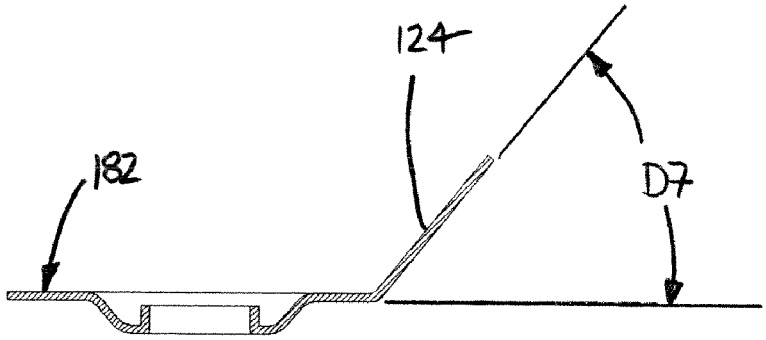
FIG. 15A is a side elevation view, shown in cross section, of the portion of the sheet of metal shown in FIG. 15 taken along line 15A-15A.
Figure 15B:
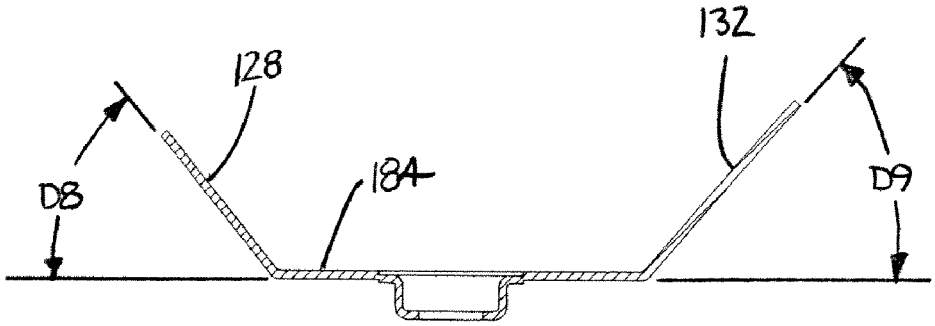
FIG. 15B is a side elevation view, shown in cross section, of the portion of the sheet of metal shown in FIG. 15 taken along line 15B-15B.

As shown in FIGS. 15, 15A and 15B, elongated tabs 124, 128 and 132 are deformed relative to end wall portions 182 and 184, respectively. As shown in FIG. 15A, elongated tab 124 is bent upwardly at an angle D7 relative to the end wall portion. It will be appreciated that angle D7 can extend through any angle or range of angles, up or down, that are suitable for providing the final fit, form and function of the tab with the elongated body and/or end walls, depending on the desired size, shape and configuration of the resulting stamped bucket. For example, angle D7 is shown in FIG. 15A at about 50 degrees.

Tabs 128 and 132 are respectively bent at angles D8 and D9 relative to end wall portion 184. It will be appreciated that angles D8 and D9 can extend through any angle or range of angles, up or down, that are suitable for providing the final fit, form and function of the tabs with the elongated body and/or end walls, depending on the desired size, shape and configuration of the resulting stamped bucket. For example, angles D8 and D9 are both shown in FIG. 15B at about 50 degrees. It is to be specifically understood that angles D6, D7, D8 and D9 can be formed independently relative to one another at any suitable angle desired depending on the configuration of the resulting bucket and the steps or stages used to form the same, among other things.

Figure 16:
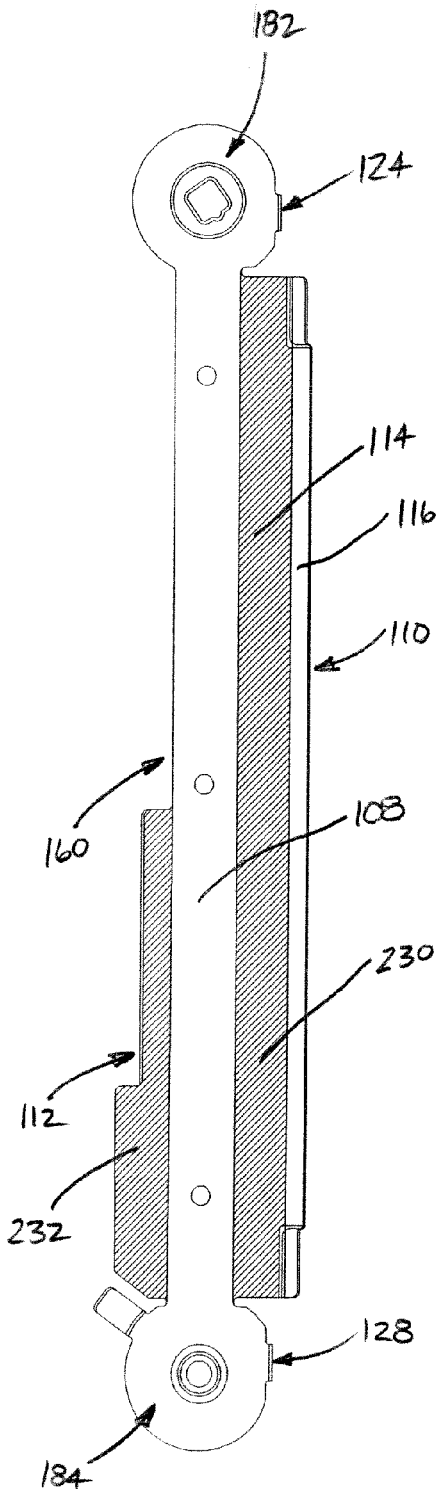
FIG. 16 is a top plan view of the portion of the sheet of metal shown in FIG. 15 illustrating another step in foaming the stamped bucket shown in FIG. 1.
Figure 17:
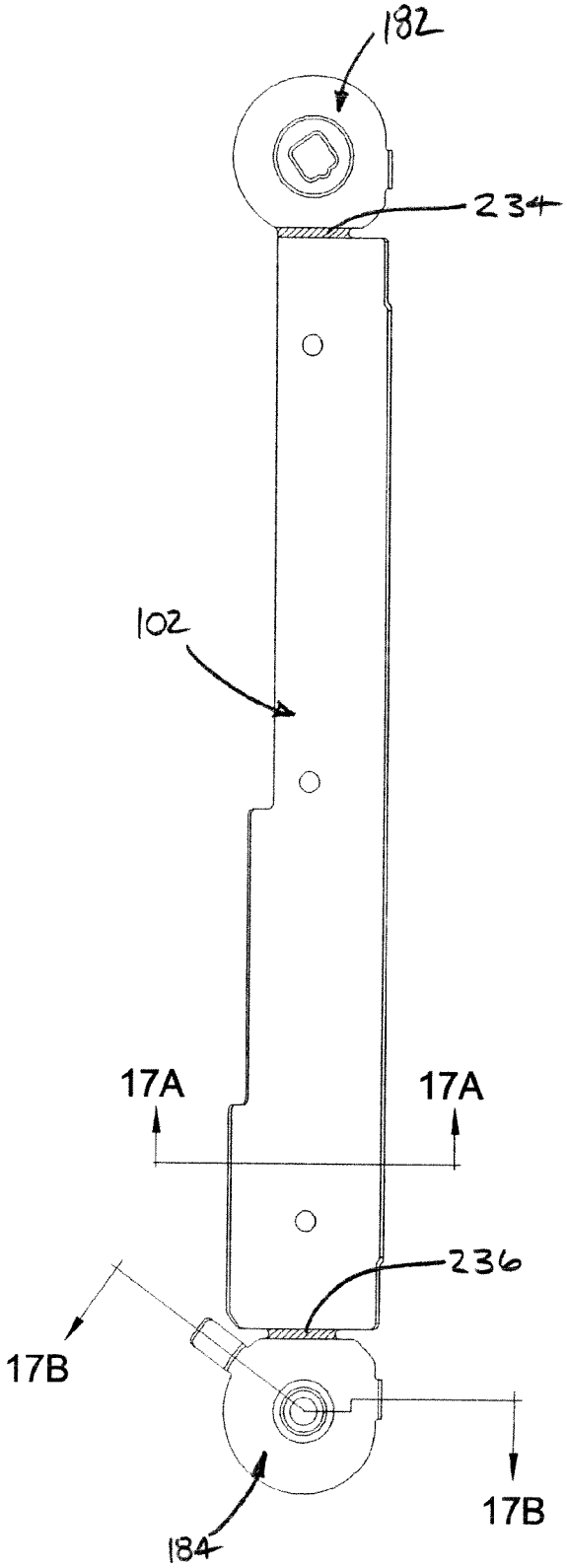
FIG. 17 is a top plan view of the portion of the sheet of metal shown in FIG. 16 illustrating another step in forming the stamped bucket shown in FIG. 1.
Figure 17A:
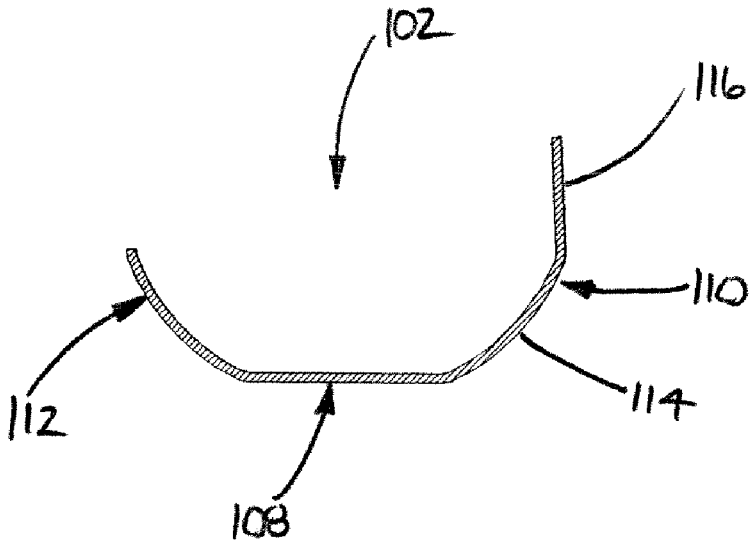
FIG. 17A is a side elevation view, shown in cross section, of the portion of the sheet of metal shown in FIG. 17 taken along line 17A-17A.
Figure 17B:
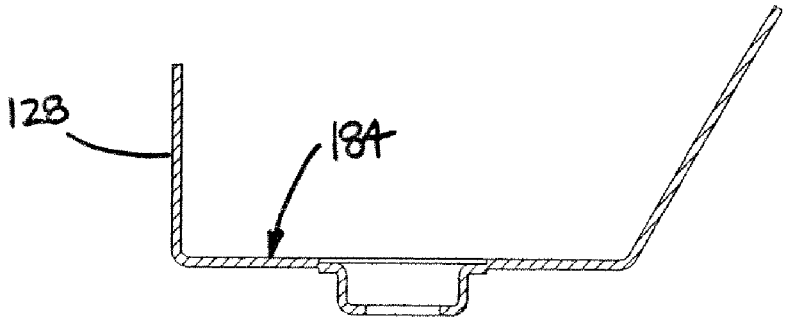
FIG. 17B is a side elevation view, shown in cross section, of the portion of the sheet of metal shown in FIG. 17 taken along line 17B-17B.
Figure 18:
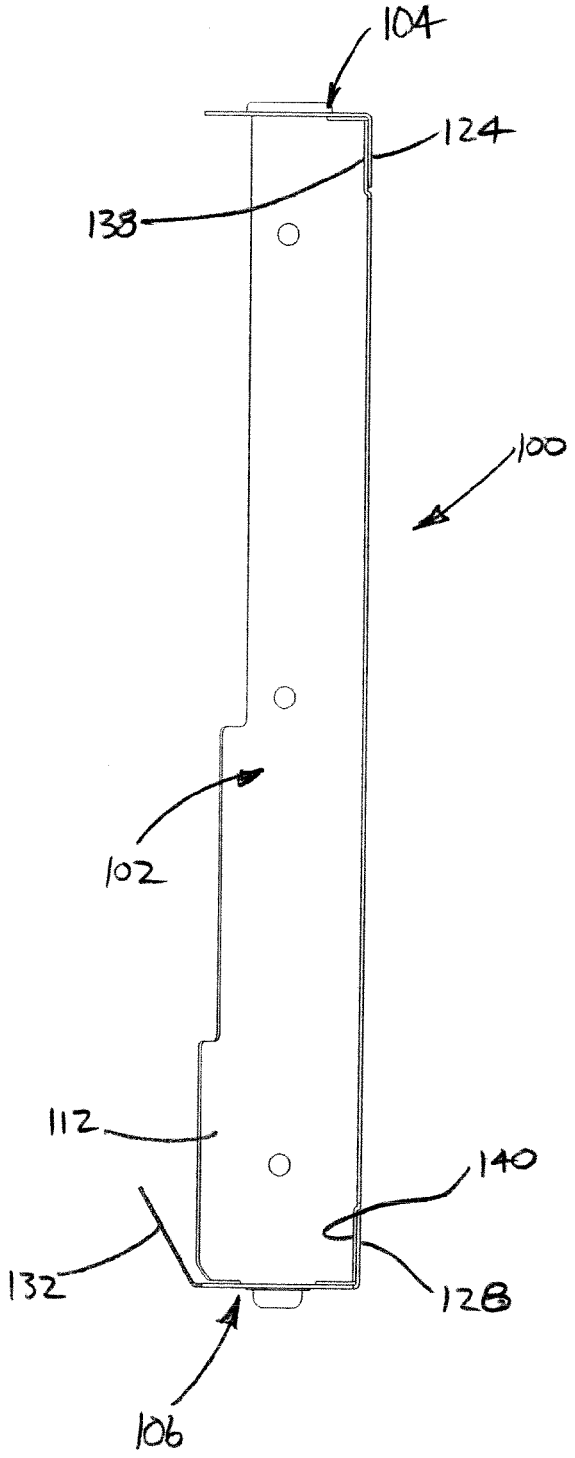
FIG. 18 is a top plan view of the portion of the sheet of metal shown in FIG. 17 illustrating another step in forming the stamped bucket shown in FIG. 1.
Figure 19:
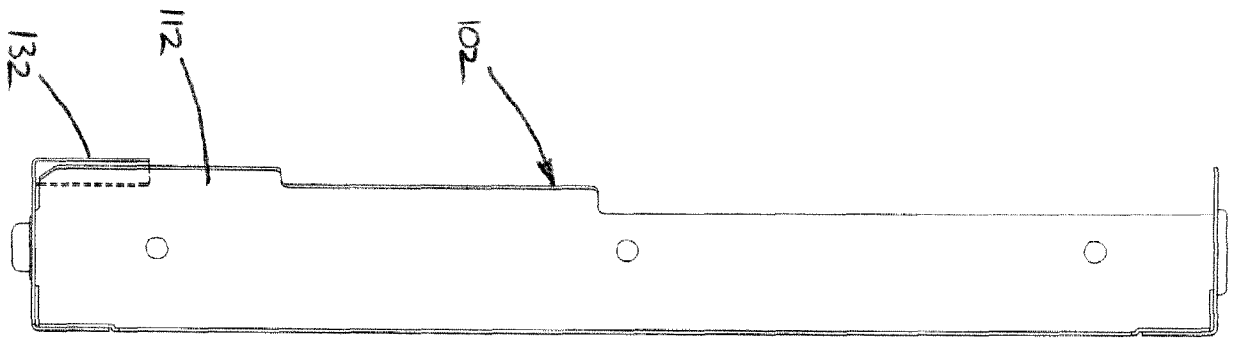
FIG. 19 is a top plan view of the portion of the sheet of metal shown in FIG. 18 illustrating another step in forming the stamped bucket shown in FIG. 1.

Turning now to FIGS. 16 and 17, areas 230 and 232 of bucket blank 160, as shown in FIG. 16, are formed from bottom wall portion 108 to form side wall portions 110 and 112 as shown in FIGS. 17 and 17A. Lower section 114 of side wall portion 110 and also side wall portion 112 extend opposite one another each in a generally curvilinear manner. As such, elongated body 102 is formed at this stage as shown in FIGS. 17 and 17A. Additionally, tabs 124 and 128 are respectively formed or otherwise bent into generally transverse relation with end wall portions 182 and 184. Areas 234 and 236 shown in FIG. 17 respectively form corners 120 and 122 shown in FIG. 1 as end wall portions 182 and 184 are respectively bent or otherwise formed into substantially transverse relation to elongated body 102 as shown in FIG. 18. Additionally, tabs 124 and 128 abuttingly engage offset areas 138 and 140 respectively of elongated body 102. In FIG. 18, tab 132 extends away from side wall portion 112 of body 102. As shown in FIG. 19, tab 132 can be bent or formed into abutting engagement with side wall portion 112 of body 102 in yet another step or stage.

Figure 20:
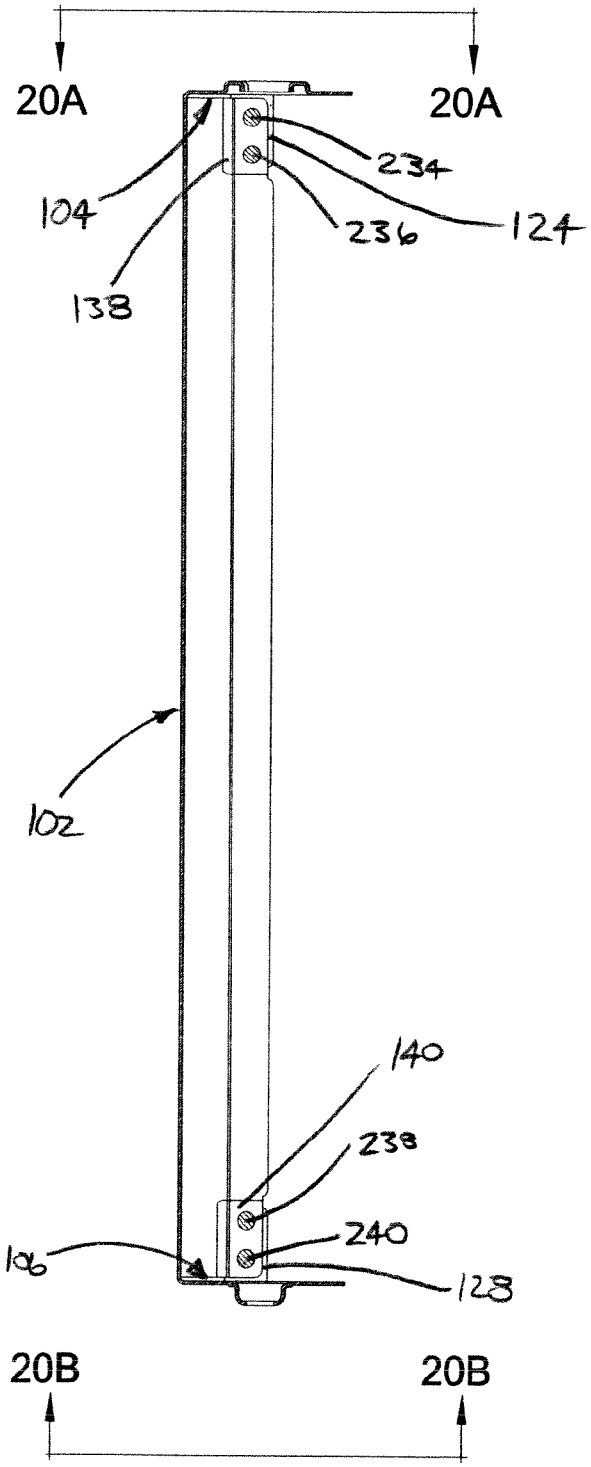
FIG. 20 is a top plan view of the portion of the sheet of metal shown in FIG. 19 illustrating another step in forming the stamped bucket shown in FIG. 1.
Figure 20A:
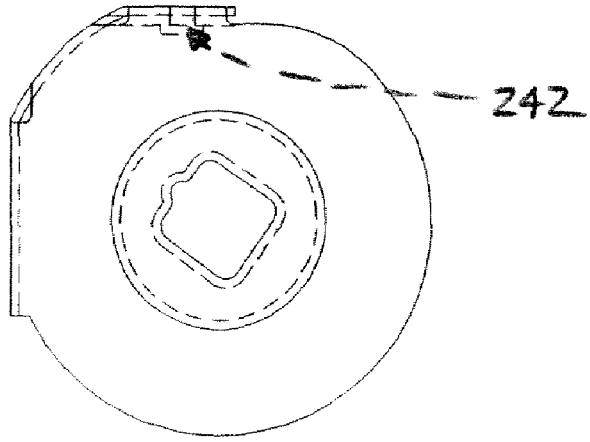
FIG. 20A is a side elevation view, shown in cross section, of the portion of the sheet of metal shown in FIG. 20 taken along line 20A-20A.
Figure 20B:
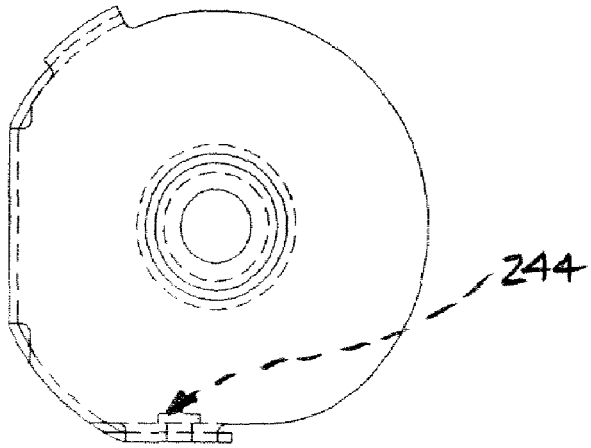
FIG. 20B is a side elevation view, shown in cross section, of the portion of the sheet of metal shown in FIG. 20 taken along line 20B-20B.

Prior to the steps shown in FIGS. 20, 20A and 20B, body 102 and end walls 104 and 106 are rotated into position such that offset areas 138 and 140 and elongated tabs 124 and 128 are accessible. Once so positioned, TOX joints can be formed in areas 234, 236, 238 and 240 as shown in FIG. 20. It will be appreciated that the TOX joints form bosses 242 and 244 shown respectively in FIGS. 20A and 20B.

Figure 21:
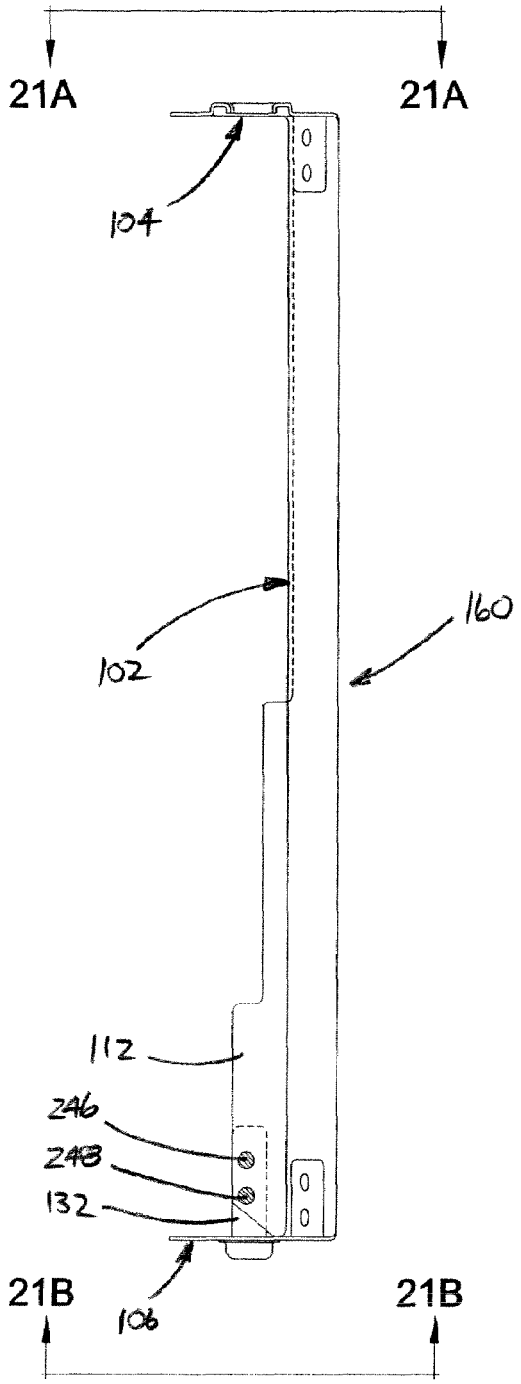
FIG. 21 is a top plan view of the portion of the sheet of metal shown in FIG. 20 illustrating another step in forming the stamped bucket shown in FIG. 1.
Figure 21A:
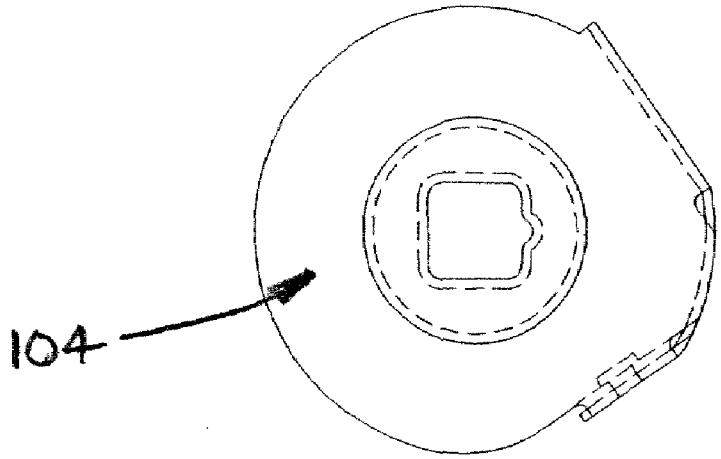
FIG. 21A is a side elevation view, shown in cross section, of the portion of the sheet of metal shown in FIG. 21 taken along line 21A-21A.
Figure 21B:
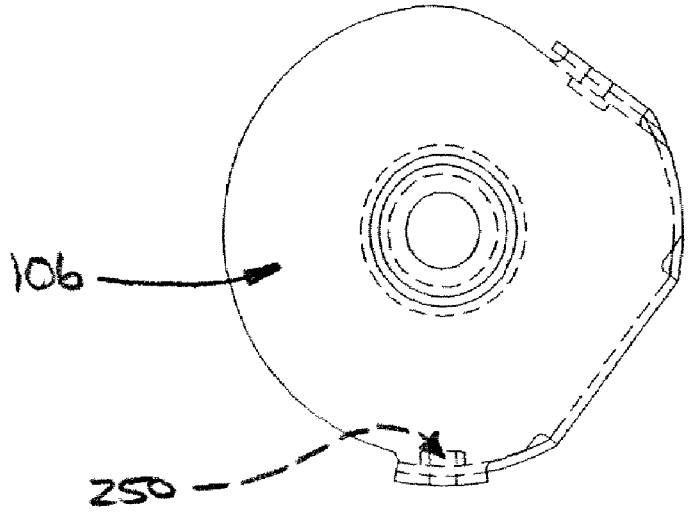
FIG. 21B is a side elevation view, shown in cross section, of the portion of the sheet of metal shown in FIG. 21 taken along line 21B-21B.

Prior to the next forming operation, body 102 and integral end walls 104 and 106 are rotated into the position shown in FIGS. 21, 21A and 21B such that side wall portion 112 and elongated tab 132 are accessible. TOX joints are formed areas 246 and 248 forming bosses 250 shown in FIG. 21B to secure tab 132 to side wall portion 112. It will be appreciated that other features and details can optionally be provided on end walls 104 and 106, shown respectively in FIGS. 21A and 21B, in this or any of the other earlier operations, steps or stages.

While the invention has been described with reference to the preferred embodiments and considerable emphasis has been placed herein on the structures and structural interrelationships between the component parts of the embodiments disclosed, it will be appreciated that other embodiments of the invention can be made and that many changes can be made in the embodiments illustrated and described without departing from the principles of the invention. Obviously, modifications and alterations will occur to others upon reading and understanding the preceding detailed description. Accordingly, it is to be distinctly understood that the foregoing descriptive matter is to be interpreted merely as illustrative of the present invention and not as a limitation. As such, it is intended that the invention be construed as including all such modifications and alterations insofar as they come within the scope of the appended claims and the equivalents thereof.

What is claimed is:

1. A method of forming a bucket for a vending machine, said method comprising:

forming a blank from a sheet of metal, said blank including a body wall extending longitudinally between opposing first and second ends, a first end wall disposed along said first end of said body wall, a second end wall disposed along said second end of said body wall, a first connecting wall portion extending between and operatively interconnecting said body wall and said first end wall and a second connecting wall portion extending between and operatively interconnecting said body wall and said second end wall, said first end wall including a first peripheral edge portion and a first tab portion projecting outwardly beyond said first peripheral edge portion, said second end wall including a second peripheral edge portion and a second tab portion projecting outwardly beyond said second peripheral edge portion;

forming said body wall of said blank into an elongated central wall portion, a first elongated wall portion disposed adjacent said elongated central wall portion and at a first non-zero angle relative thereto and a second elongated wall portion disposed adjacent said elongated central wall portion opposite said first elongated wall portion and at a second non-zero angle relative to said elongated central wall portion such that a longitudinal axis is at least partially defined along said body wall with said elongated central wall portion, said first elongated wall portion and said second elongated wall portion disposed about said longitudinal axis;

forming said first end wall into a generally transverse orientation with respect to said longitudinal axis such that a first open interface is formed between said first end wall and said body wall;

forming said second end wall into a generally transverse orientation with respect to said longitudinal axis such that a second open interface is formed between said second end wall and said body wall;

forming said first tab portion into a generally transverse orientation with respect to said first end wall such that said first tab portion is disposed adjacent one of said first and second elongated wall portions of said body wall;

forming said second tab portion into a generally transverse orientation with respect to said second end wall such that said second tab portion is disposed adjacent one of said first and second elongated wall portions of said body wall;

attaching said first tab portion to said one of said first and second elongated wall portions of said body wall such that said first tab portion bridges said first open interface and at least partially prevents displacement of said first end wall with respect to said body wall; and, attaching said second tab portion to said one of said first and second elongated wall portions of said body wall such that said second tab portion bridges said second open interface and at least partially prevents displacement of said second end wall with respect to said body wall.

2. A method according to claim 1, wherein said action of forming said first end wall into a generally transverse orientation includes bending said first connecting wall portion and said action of forming said second end wall into a generally transverse orientation includes bending said second connecting wall portion.

3. A method according to claim 1, wherein said action of forming a blank includes forming a substantially planar blank from a substantially planar section of said sheet of metal.

4. A method according to claim 1 further comprising an action of forming at least one contoured surface along said body wall.

5. A method according to claim 1 further comprising an action of rotating said bucket prior to said actions of attaching said first and said second tab portions.

6. A method according to claim 1 further comprising an action of forming a substantially cylindrical boss on said first end wall.

7. A method according to claim 1 further comprising an action of forming an opening through said first end wall.

8. A method according to claim 1, wherein said action of forming blank includes forming first and second longitudinally-extending side edges on said body wall that includes a step disposed between said first and second ends such that an associated plurality of articles can be dispensed independently during a single rotation of said body wall about said longitudinal axis.

9. A method according to claim 1, wherein said action of forming said body wall includes forming said elongated central wall portion with a substantially planar surface and at least one of said first and second elongated wall portions with a curvilinear surface extending longitudinally along said longitudinal axis.

10. A method according to claim 1, wherein said action of forming an elongated central wall portion includes forming said elongated central wall portion from a section of said body wall that is interconnected with said first and second connecting wall portions.

11. A method according to claim 1, wherein attaching said first tab portion includes forming an upset-pressing type fastener between said first tab portion and said one of said first and second elongated wall portions.

12. A method according to claim 11, wherein attaching said second tab portion includes forming an upset-pressing type fastener between said second tab portion and said one of said first and second elongated wall portions.

13. A method according to claim 1, wherein said action of forming said first end wall on said blank includes forming a third tab portion projecting outwardly beyond said first peripheral edge portion.

14. A method according to claim 13 further comprising forming said third tab portion into a generally transverse orientation with respect to said first end wall such that said third tab portion is disposed adjacent one of said first and second elongated wall portions of said body wall, and attaching said third tab portion to said one of said first and second elongated wall portions.

* * * * *